US010025273B2

(12) United States Patent
Iguchi

(10) Patent No.: US 10,025,273 B2
(45) Date of Patent: Jul. 17, 2018

(54) TIMEPIECE

(71) Applicant: Seiko Instruments Inc., Chiba-shi, Chiba (JP)

(72) Inventor: Katsunobu Iguchi, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 15/410,274

(22) Filed: Jan. 19, 2017

(65) Prior Publication Data

US 2017/0212474 A1 Jul. 27, 2017

(30) Foreign Application Priority Data

Jan. 21, 2016 (JP) ..... 2016-009971

(51) Int. Cl.
*G04B 37/00* (2006.01)

(52) U.S. Cl.
CPC ..... *G04B 37/0008* (2013.01)

(58) Field of Classification Search
CPC .. G04B 37/0008; G04B 37/084; G04B 39/00; G04B 37/221; G04B 47/046; G04B 37/05; G04B 29/027; G04G 17/00
USPC ..... 368/276, 88, 281, 286–287, 291–294, 368/296–300, 309
See application file for complete search history.

(56) References Cited

U.S. PATENT DOCUMENTS 4,281,406 A * 7/1981 Tanaka ..... G04G 17/00 368/300
4,544,284 A * 10/1985 Geiger ..... G04B 37/0058 368/294
4,696,577 A * 9/1987 Muller ..... G04B 29/027 368/276
5,825,722 A * 10/1998 Meyrat ..... G04B 37/05 368/276
6,406,178 B1 * 6/2002 Luscher ..... G04B 37/0008 368/286

FOREIGN PATENT DOCUMENTS

JP 2002-189084 A 7/2002

* cited by examiner

*Primary Examiner* — Edwin A. Leon
(74) *Attorney, Agent, or Firm* — Brinks Gilson & Lione

(57) ABSTRACT

A timepiece in which the width of an edge member mounted to a case band while supporting a transparent member is small is provided. A case accommodating a dial is equipped with an edge portion arranged outside a case band of the case, a cylindrical portion arranged inside the case band, and an edge member having a receiving portion. The edge portion supports a transparent member. The cylindrical portion supports the peripheral portion of the dial from the front side of the case and prescribes the display diameter D of the dial. The receiving portion protrudes from the outer periphery of the cylindrical portion or from the cylindrical portion toward the rear surface side of the case. The edge member is mounted to the case band by a drawing-in mechanism equipped with a drawing-in member and a drawing-in screw.

12 Claims, 14 Drawing Sheets

TIMEPIECE

RELATED APPLICATIONS

This application claims priority under 35 U.S.C. § 119 to Japanese Patent Application No. 2016-009971 filed on Jan. 21, 2016, the entire content of which is hereby incorporated by reference.

BACKGROUND OF THE INVENTION

1. Field of the Invention

The present invention relates to a timepiece such as a portable timepiece like a wristwatch or a pocket watch, a table clock, and a wall-hanging timepiece.

2. Description of Related Art

Regarding a wristwatch, etc., various constructions are known in which an edge member supporting a transparent member (usually made of glass) opposite a dial is mounted to a case band of a case.

In a first example, an insertion portion including a part of the edge member and having a circular outer periphery is inserted from the front side of the case into an interior which is formed in the case band and the inner periphery of which is surrounded by a circular edge member mounting portion, and, between the insertion portion and the edge member mounting portion, there is held a ring formed of soft plastic in a state in which it is compressed in the radial direction of the case. Due to this construction, the edge member is mounted to the case band via the ring. In this mounting condition, the edge portion of the edge member supporting the transparent member covers the edge member mounting portion while in contact with the edge member mounting portion from the front side of the case.

In a second example, an insertion portion including a part of the edge member and having a circular outer periphery is forced from the front side of the case into an interior which is formed in the case band and the inner periphery of which is surrounded by a circular edge member mounting portion, and an engagement groove formed so as to be open in the inner peripheral surface of the edge member mounting portion and an engagement protrusion protruding from an outer peripheral surface of the insertion portion of the edge member are engage with each other in a hooked fashion. Due to this construction, the edge member is mounted to the case band in a state in which the edge member mounting portion is held between the edge portion of the edge member supporting the transparent member and the engagement protrusion. In this mounting state, the edge portion of the edge member covers the edge member mounting portion while in contact with the edge member mounting portion from the front side of the case.

In a third example, an inner peripheral surface of an edge member mounting portion which is formed on a case band and the inner periphery of which is circular, and an outer peripheral surface of an insertion portion which includes a part of an edge member, the outer periphery of which is circular, and which is surrounded by the edge member mounting portion of the case band, are respectively formed as inclined surfaces gradually reduced in diameter as they extend toward the front side of a case. And, the insertion portion is forced into the interior surrounded by the edge member mounting portion. As a result, the edge member is mounted to the case band in a state in which the inner peripheral surface of the edge member mounting portion and the outer peripheral surface of the insertion portion are in contact with each other. In this mounting state, the edge portion of the edge member supporting a transparent member covers the edge member mounting portion while in contact with the edge member mounting portion from the front side of the case.

When performing correction during the production of a timepiece, and when performing maintenance on the timepiece, the edge member may be detached from the case band. In this case, in the above first through third examples, a tool is inserted between the edge member mounting portion and the edge portion of the edge member covering the same, and prying is performed with this tool, whereby the edge member is detached. Thus, as the edge member is pried open, the case band and the edge member may be damaged.

Further, in the first through third examples, when the edge member is mounted to the case band through the operation of inserting or forcing the insertion portion of the edge member into the interior surrounded by the edge member mounting portion of the case band, and also when the edge member is detached from the case band as described above, it is impossible to avoid stress from acting on the edge portion. Thus, in the construction in which the transparent member is supported by the edge portion of the edge member by using adhesive, there is a fear of adhesive separation due to the above-mentioned stress. To cope with this, it is necessary to adopt a construction in which soft plastic is provided between the edge portion of the edge member and the transparent member, so that the degree of freedom in terms of design for supporting the transparent member is rather low.

In addition, in the above-mentioned third example, when the edge member is repeatedly attached and detached to and from the case band, both the inner peripheral surface of the edge member mounting portion and the outer peripheral surface of the insertion portion of the edge member interfere with each other, and the possibility of scraping is high. Thus, the reproducibility for appropriately mounting the edge member to the case band is low.

On the other hand, there is known a wristwatch free from the various problems mentioned above (e.g., See JP-A-2002-189084 (Patent Document 1)).

In this wristwatch, in the edge member supporting the transparent member, there is formed a screw hole reaching the edge portion, and, in the case band accommodating a movement with hands and a dial, there is formed a screw escape hole communicating with the screw hole of the edge member. And, a screw inserted into the screw escape hole from the rear surface (back surface) of the case band toward the screw hole is screwed into the screw hole of the edge portion, with a waterproof gasket being arranged between the edge portion of the edge member and the edge member mounting portion of the case band covered with this edge portion. Through the fastening of this screw, the edge member is drawn toward the rear surface side from the front surface side of the case, and the edge member is mounted to the case band, with the edge portion of the edge member covering the edge member mounting portion while in contact with the edge member mounting portion from the front side of the case.

The insertion portion that the edge member supporting the transparent member has determines the display diameter of the dial arranged inside the case band opposite the transparent member. Here, the display diameter of the dial is the diameter of the dial region except for the peripheral portion of the dial supported by and covered with this edge member;

in other words, it is the diameter of the dial region visible through the transparent member, and is smaller than the outer diameter of the dial.

The display diameter is prescribed as described above, whereby, when the width of the edge member, above all, the width of the edge portion is large, the display diameter of the dial is small in the case where the size of the case is prescribed; further, in the case where the display diameter of the dial is prescribed, the size of the case is large.

With the advance of the recent aging society, there is a demand for an increase in the display diameter of the dial. In this case, the size of the human wrist is as it was in the old days, so that, in the case of a wristwatch, for example, there is a demand for an increase in the display diameter of the dial while suppressing an increase in the size of the case.

In the wristwatch disclosed in Patent Document 1, however, the screw for fixing the edge member to the case band is arranged on the outer side of the outer periphery of the dial, and the screw hole is provided at the edge portion of the edge member in conformity with the screw escape hole through which this screw is passed. The wristwatch disclosed in Patent Document 1, in which the edge portion thus has a screw hole, the width of the edge member thereof is large. Thus, the wristwatch disclosed in Patent Document 1 cannot meet the demand mentioned above.

SUMMARY OF THE INVENTION

It is an object of the present invention to provide a timepiece in which the width of the edge member mounted to the case band and supporting the transparent member is small.

To achieve the above object, according to the present invention, there is provided, according to the present invention, a timepiece which has a case accommodating a movement having a display panel opposite a transparent member with which the case is equipped, and in which an edge member with which the case is equipped is mounted to a case band with which the case is equipped by a drawing-in mechanism, wherein the edge member has an edge portion arranged outside the case band and supporting the transparent member, a cylindrical portion arranged inside the case band while in contact with a peripheral portion of the display panel and supporting the display panel from the front side of the case to prescribe the display diameter of the display panel, and a receiving portion provided in the outer periphery of the cylindrical portion or a receiving portion protruding from the cylindrical portion toward the rear surface side of the case; and the drawing-in mechanism is equipped with a plate portion arranged inside the case band so as to be opposite the rear surface of the display panel, a drawing-in member formed at the peripheral portion of this plate portion and configured to hook on the receiving portion from the front side of the case, and a drawing-in screw unit which is on the inner side of the outer periphery of the display panel and which is detachably and threadedly engaged with the drawing-in member from the rear side of the case.

In the timepiece according to the present invention, an engagement portion of the drawing-in member is hooked on the receiving portion of the edge member from the front side of the case. Thus, due to the drawing-in action affecting the edge member with the fastening of the screw unit of the drawing-in mechanism, the edge member supporting the transparent member is mounted to the case band, with the edge portion thereof covering the case band from the front side of the case. By loosening the screw unit of the drawing-in mechanism from the rear surface side of the case and detaching it from the drawing-in member, it is possible to release the hooking between the receiving portion of the edge member and the engagement portion of the drawing-in member. Thus, at the time of maintenance or the like, it is possible to detach the edge member from the case band to the front side of the case.

In the state in which the edge member is mounted to the case band, the drawing-in mechanism mounting the edge member to the case band and the receiving portion of the edge member are arranged on the rear surface side of the case with respect to the edge portion of the edge member; further, the plate portion of the drawing-in member that the drawing-in mechanism has is arranged opposite the rear surface of the display panel, and the screw unit that the drawing-in mechanism has is arranged on the inner side of the outer periphery of the display panel. In this construction, the screw unit is not arranged on the outer side of the outer periphery of the display panel, so that there is no need to provide the edge portion of the edge member with a screw hole receiving the screw unit. Thus, it is possible to reduce the width of the edge member supporting the transparent member.

Further, according to a preferable mode of the timepiece of the present invention, the inner peripheral surface of the cylindrical portion is continuous with the dial at right angles.

According to this preferable mode, on condition that the front side opening diameter of the case of the cylindrical portion is the same, it is possible to secure a larger display diameter for the display panel as compared with the construction in which the inner peripheral surface of the cylindrical portion is gradually reduced in diameter as it extends toward the rear surface side of the case.

Further, according to a preferable mode of the timepiece of the present invention, the engagement portion has an engagement portion base protruding from the outer periphery of the plate portion toward the front side of the case and arranged between the inner peripheral surface of the case band and the outer periphery of the display panel, and a hooking portion formed on this engagement portion base and hooked on the receiving portion provided in the outer periphery of the cylindrical portion.

According to this preferable mode, the engagement portion base of the engagement portion that the drawing-in member has is arranged between the inner peripheral surface of the case band and the outer periphery of the display panel, so that the state in which the hooking portion of the engagement portion is hooked from the front side of the case on the receiving portion provided in the outer periphery of the cylindrical portion is formed on the front side of the case with respect to the display panel. As a result, it is possible to mount the edge member to the case band with the fastening of the screw unit, so that there is no need to provide the edge portion of the edge member with a screw hole receiving the screw unit. Thus, it is possible to reduce the width of the edge member supporting the transparent member.

Further, according to a preferable mode of the timepiece of the present invention, a plurality of receiving portions are provided at intervals in the peripheral direction of the cylindrical portion, and engagement portions are provided at intervals in the outer periphery of the plate portion in the same number as the receiving portions; and the hooking portion can pass through a recess formed between the receiving portions adjacent in the peripheral direction of the cylindrical portion, and is hooked on the receiving portions while deviated from the recess.

According to this preferred mode, in the construction in which the hooking between the hooking portion of the engagement portion and the receiving portion provided in the outer periphery of the cylindrical portion is arranged on the front side of the case with respect to the dial, by changing the relative positions in the peripheral direction of the edge member and the drawing-in member in the state in which the hooking portion formed on the engagement portion base arranged between the inner peripheral surface of the case band and the outer periphery of the display panel is passed through the recess of the cylindrical portion, it is possible to attain a state in which the hooking portion can be hooked on the receiving portion from the front side of the case. Thus, it is possible to mount the edge member to the case band through the fastening of the screw unit.

Here, to change in the peripheral direction the passing of the hooking portion with respect to the recess and the relative positions of the edge member and the drawing-in member, it is possible to perform it while successively mounting the drawing-in member, the movement having the display panel, the edge member supporting the transparent member, etc. in that order to the case band; however, it is more desirable to perform it when assembling the drawing-in member, the movement having the display panel, the edge member supporting the transparent member, etc. outside the case band. And, in the latter case, there is formed an assembly in which the drawing-in member, the movement having the display panel, the edge member supporting the transparent member, etc. are assembled, and in which the hooking portion can be hooked on the receiving portion, so that it is possible to mount this assembly to the case band by a screw unit.

Further, according to a preferable mode of the timepiece of the present invention, the plurality of receiving portions have an engagement groove open on the front side of the case in substantially the same width as the hooking portion at positions deviated in the peripheral direction of the edge member with respect to the recess, and the hooking portion is hooked on the receiving portion while fit-engaged with the engagement groove from the front side of the case.

According to this preferable mode, the hooking portion is hooked on the receiving portion in a state in which the hooking portion is fit-engaged with the engagement groove the receiving portion has, so that it is possible to maintain the edge member mounted to the case band by the drawing-in mechanism so that it may not inadvertently move in the peripheral direction thereof. Thus, in the case of a timepiece to the edge portion of the edge member of which a display such as a mark is imparted, it is possible to prevent the positional display such as a mark from being deviated from a predetermined position. At the same time, when adopting the above-mentioned assembly and fixing it to the case band by a screw unit, the hooking of the hooking portion on the receiving portion is maintained by the above-described detent, whereby the assembly in a state in which the edge member and the drawing-in member are appropriately set in position can be fixed to the case band by the screw unit.

Further, according to a preferable mode of the timepiece of the present invention, the receiving portion protruding from the cylindrical portion toward the rear surface side of the case band has a receiving portion base arranged between the inner peripheral surface of the case band and the outer periphery of the display panel, and a lock portion formed on this receiving portion base and configured to receive the engagement portion formed at the peripheral portion of the plate portion from the rear surface side of the case.

According to this preferable mode, the receiving portion base of the receiving portion protruding from the cylindrical portion toward the rear surface side of the case band is arranged between the inner peripheral surface of the case band and the outer periphery of the display panel. Thus, there is formed on the rear surface side of the case with respect to the display panel a condition in which the engagement portion formed at the peripheral portion of the plate portion with which the drawing-in member is equipped is hooked on the lock portion of the receiving portion from the front side of the case. As a result, it is possible to mount the edge member to the case band through the fastening of the screw unit, so that there is no need to provide the edge portion of the edge member with a screw hole receiving the screw unit. Thus, it is possible to reduce the width of the edge member supporting the transparent member.

Further, according to a preferred mode of the timepiece of the present invention, a plurality of receiving portions are provided at intervals in the peripheral direction of the cylindrical portion, and the engagement portions are provided at intervals in the outer periphery of the plate portion in the same number as the receiving portions; and the receiving portions can pass through a recess formed between the engagement portions adjacent in the peripheral direction of the plate portion, and receive the engagement portions from the rear surface side of the case while deviated from the recess.

According to this preferable mode, in the construction in which there is arranged on the rear surface side of the case with respect to the display panel a state in which the engagement portion of the plate portion is hooked from the front side of the case on the lock portion of the receiving portion protruding from the cylindrical portion toward the rear surface side of the case band, the lock portion formed on the receiving portion base arranged between the inner peripheral surface of the case band and the outer periphery of the display panel is passed through the recess between the adjacent engagement portions of the plate portion and, in this state, the relative position in the peripheral direction of the edge member and the drawing-in member is changed, whereby it is possible to attain a state in which the engagement portion and the lock portion can be hooked on each other in the direction of the thickness of the case. Thus, the edge member can be mounted to the case band through the fastening of the screw unit from the rear surface side of the case.

Here, while it is possible to pass the receiving portion of the edge member through the recess of the drawing-in member, and to change the relative position of the edge member and the drawing-in member in the peripheral direction while successively mounting the drawing-in member, the movement with the display panel, and the edge member supporting the transparent member to the case band in that order, it is more desirable to do so when assembling the drawing-in member, the movement with the display panel, and the edge member supporting the transparent member outside the case band. And, in the latter case, the drawing-in member, the movement with the display panel, and the edge member supporting the transparent member are assembled to form an assembly in which the hooking portion of the drawing-in member and the lock portion of the receiving portion can be hooked on each other, so that it is possible to mount this assembly to the case band by the screw unit.

According to a preferable mode of the timepiece of the present invention, the screw unit is a screw threadedly engaged with the plate portion.

Further, according to this preferable mode, an inexpensive general-purpose screw may be employed as the screw unit.

Further, according to a preferable mode of the timepiece of the present invention, the entire screw is arranged inside the case band, and the screw is covered with and hidden by a case back of the case mounted to the case band.

According to this preferable mode, the screw is covered with and hidden by the case back of the case, so that the case rear surface is of a satisfactory outward appearance. At the same time, there is no need to perform boring on the case back of the case to pass the screw, which is also desirable in that there is formed no intrusion route for water in the case back.

Further, according to a preferable mode of the timepiece of the present invention, the case is equipped with a case back arranged so as to be in contact with the case band from the rear surface side of the case, and the drawing-in member further has an annular tubular portion protruding from the plate portion in the direction of the rear surface of the case and having a female screw portion in the inner peripheral surface thereof to be baffled in rotation with respect to the case band; and the screw unit is formed on the case back, and is a male screw portion threadedly engaged with the female screw portion.

According to this preferable mode, the drawing-in member is baffled in rotation with respect to the case band, and the male screw portion formed on the case back is threaded into the female screw portion of the annular tubular portion this drawing-in member has. As a result, the case back is mounted so as to be in contact with the case band from the rear surface side of the case, and the edge member is mounted to the case band via the drawing-in member. Thus, the male screw portion of the case back also serves as the screw unit, so that it is possible to achieve a reduction in the number of components.

Further, according to a preferable mode of the timepiece of the present invention, the receiving portion provided in the outer periphery of the cylindrical portion and the hooking portion provided on the drawing-in member are respectively formed in the direction of the thickness of the case in plural numbers, and are hooked on each other. In this preferable mode, the receiving portion can be formed by the male screw portion, and the hooking portion can be formed by the female screw portion; further, the plurality of receiving portions and hooking portions are respectively formed as recesses and protrusions, and it is possible to provide a recess between the receiving portions adjacent in the peripheral direction.

According to this preferable mode, at a plurality of positions in the direction of the thickness of the case, the receiving portions and the hooking portions are substantially hooked on each other. Thus, even in the case where the protrusion width of the receiving portions and the hooking portions is small, the reliability in the hooking between the receiving portions and the hooking portions is enhanced, and it is possible to more reliably mount the edge member to the case band by the drawing-in mechanism.

Further, according to a preferable mode of the timepiece of the present invention, a head portion of the screw is exposed in the rear surface of the case.

According to this preferable mode, the head portion of the screw is not covered with and hidden by the case, and it is possible to visually check whether or not it is at a predetermined position of the rear surface of the case. As a result, it is possible to make sure that the screw has been mounted without fail in the inspection operation or the like.

According to the present invention, it is possible to provide a timepiece in which the width of the edge member mounted to the case band while supporting the transparent member is small.

DETAILED DESCRIPTION OF THE PREFERRED EMBODIMENTS

The first embodiment of the present invention will be described with reference to FIGS. 1 through 5.

Figure 1:
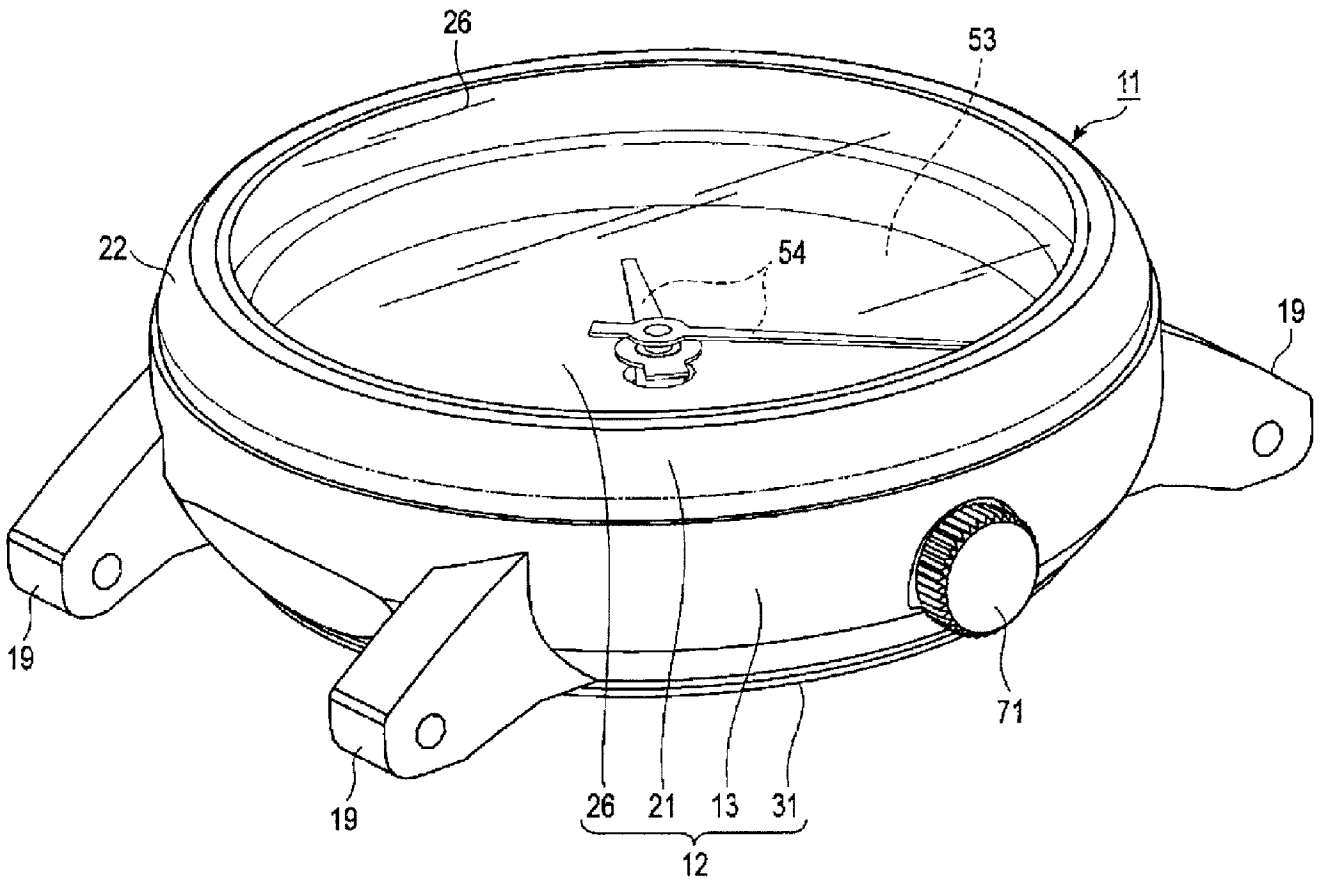
FIG. 1 is a perspective view of a wristwatch according to a first embodiment of the present invention.
Figure 2:
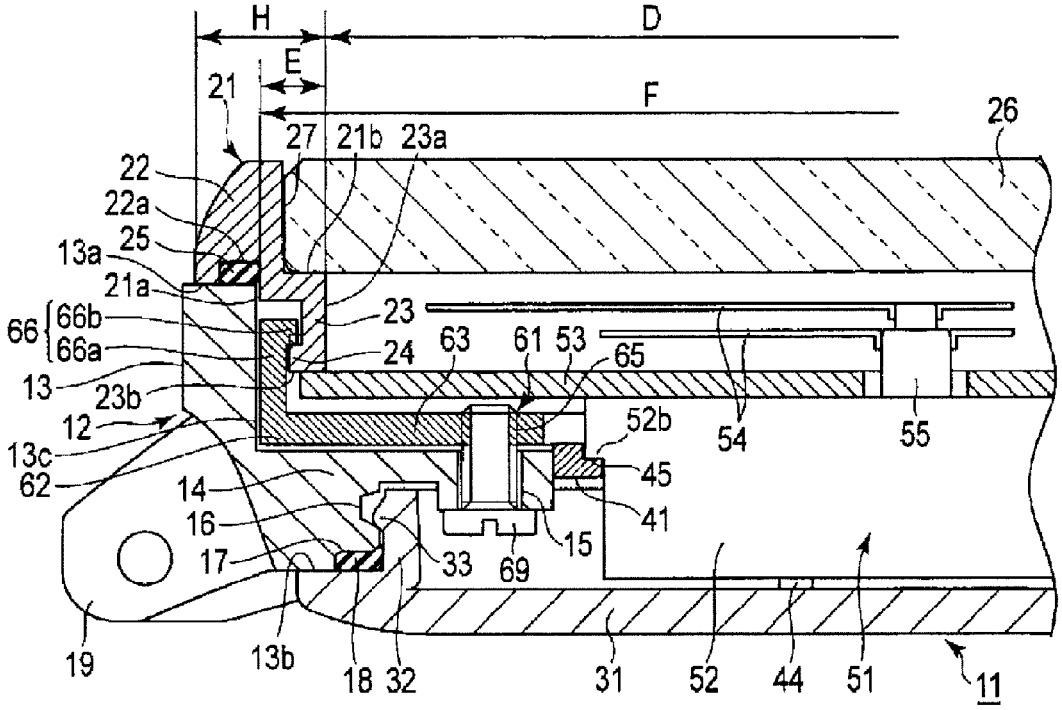
FIG. 2 is a sectional view illustrating a part of the wristwatch of FIG. 1.
Figure 5:
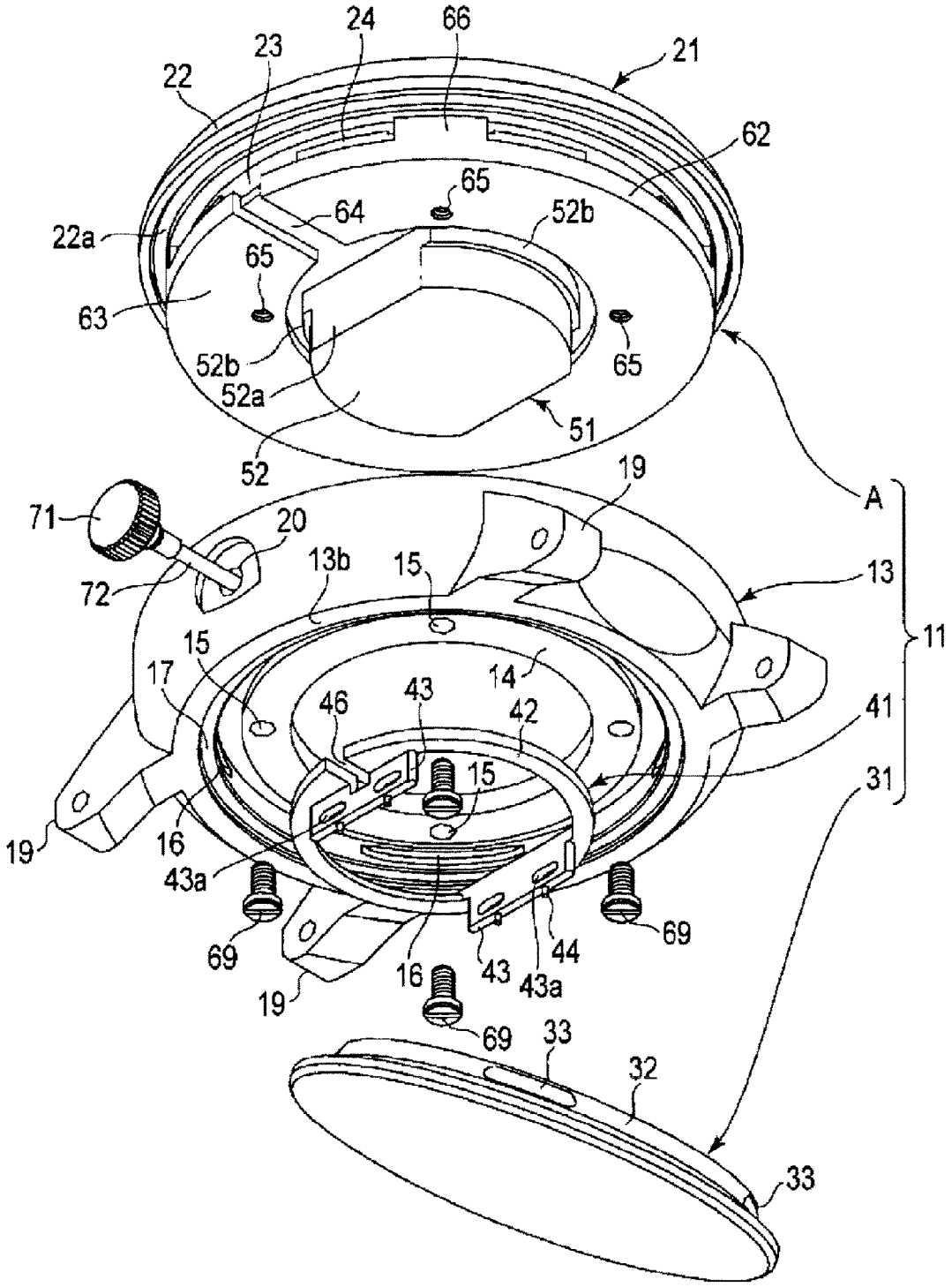
FIG. 5 is an exploded perspective view of the wristwatch shown in FIG. 1.

In FIGS. 1, 2, and 5, numeral 11 indicates a timepiece such as a portable timepiece, more specifically, a wristwatch. The wristwatch 11 is equipped with a case 12 constituting the exterior thereof.

As shown in FIGS. 1 and 2, the case 12 is equipped with a case band 13, an edge member 21, a transparent member 26, and a case back 31.

The case band 13 is of a single-piece construction, and is preferably formed of metal such as stainless steel or titanium; however, it may also be formed of synthetic resin. Both sides in the thickness direction of the case band 13 are respectively open. As shown in FIG. 2, the case band 13 has an annular edge receiving surface 13*a* including a flat surface continuous in the peripheral direction, and an annular cover receiving surface 13*b* likewise including a flat surface continuous in the peripheral direction. The edge receiving surface 13*a* is formed by one end surface in the thickness direction of the case band 13 situated on the front side of the case 12.

As shown in FIG. 2, a case band bottom portion 14 is provided on the other end portion side in the thickness direction of the case band 13. This case band bottom portion 14 protrudes integrally toward the interior of the case band 13, and, is formed continuously without a gap in the peripheral direction as shown in FIG. 5. The cover receiving surface 13*b* is situated on the rear surface side of the case 12 and is formed, for example, by the rear surface of the case band bottom portion 14 also serving as the other end surface in the thickness direction of the case band 13.

The case band bottom portion 14 has a through-hole 15, a lock groove 16, and a gasket groove 17.

The through-hole 15 is provided at a plurality of positions of the inner peripheral side portion of the case band bottom portion 14, for example, at four positions as shown in FIG. 5, so as to extend through the inner peripheral side portion in the thickness direction thereof. It is desirable for these through-holes 15 to be provided at intervals in the peripheral direction and, more preferably, at equal intervals.

As shown in FIG. 5, the lock grooves 16 are provided at intervals in the peripheral direction of the case band 13 with respect to the base side portion of the case band bottom portion 14, and each is formed as a groove open to the interior of the case band 13.

The gasket groove 17 is provided continuously without a gap in the peripheral direction so as to be open to the cover receiving surface 13*b* at the base side portion, and an annular waterproof gasket 18 formed of a sealing material having elasticity such as rubber is embedded therein.

The case band has connection protrusions 19 protruding integrally from the outer peripheral surface thereof. An arm attachment member such as a band or a belt (not shown) is connected to the pair of connection protrusions 19 opposite each other in the 3 o'clock-9 o'clock direction of the timepiece. Further, as shown in FIG. 5, a winding stem passing hole 20 is formed in the case band 13 so as to extend through it in the radial direction thereof.

As shown in FIG. 2, etc., the edge member 21 of the case 12 has an edge portion 22, a cylindrical portion 23, and a receiving portion 24. This edge member 21 is a single-piece component, and it is desirable for the member to be formed of metal such as stainless steel and titanium; however, it may be formed of synthetic resin.

The edge portion 22 is arranged outside the case band 13, and is a portion overlapping the edge receiving surface 13*a* of the case band 13. In the back surface of this edge portion 22, there is formed a gasket groove 22*a* continuous without a gap in the peripheral direction, and an annular waterproof gasket 25 formed of an elastic sealing material such as rubber is fitted therein.

A cylindrical portion 23 is a portion which protrudes integrally from the inner peripheral side back surface of the edge portion 22, and which is inserted into the case band 13 to be arranged therein. An inner peripheral surface 23*a* of the cylindrical portion 23 is of a smaller diameter than the inner peripheral surface of the edge portion 22. The inner peripheral surface 23*a* of the cylindrical portion 23 is a parting surface determining the display diameter of the dial described below. It is desirable for the diameter of this inner peripheral surface 23*a* to be fixed and exhibit no change in the height direction of the edge member 21; however, it may also be gradually increased in size as it approaches the edge portion 22.

The cylindrical portion 23 has a plate receiving surface 23*b*. The plate receiving surface 23*b* is formed, for example, by the end surface of the cylindrical portion 23 situated on the rear surface side of the case 12; however, it can also be formed between the end surface of the cylindrical portion 23 situated on the rear surface side of the case 12 and the end surface of the cylindrical portion 23 situated on the front side of the case 12.

The end surface of the cylindrical portion 23 situated on the front side of the case 12 and the inner peripheral surface of the edge portion 22 constitute a member receiving surface 21*b* continuous at right angles. In FIGS. 1 through 4, numeral 26 indicates a transparent member formed in a circular configuration of a transparent material such as transparent glass or transparent synthetic resin. The transparent member 26 is supported by the edge portion 22 in a state in which the peripheral surface thereof and the peripheral portion back surface are in contact with the member receiving surface 21*b*. The outer peripheral surface of the transparent member 26 is glued to the inner peripheral surface of the edge portion 22 by adhesive 27 (See FIG. 2).

Instead of this adhesion, it is also possible to mount a waterproof gasket to the inner peripheral surface of the edge portion 22 in an exposed state, and to cause the edge portion 22 to support the transparent member 26, with the outer peripheral surface of the transparent member being held in close contact with the inner peripheral surface of this waterproof gasket. However, in the above-mentioned adhesion structure, there is no need to machine a mounting groove for the waterproof gasket at the edge portion, and it can advantageously reduce the height of the edge portion 22.

Figure 4:
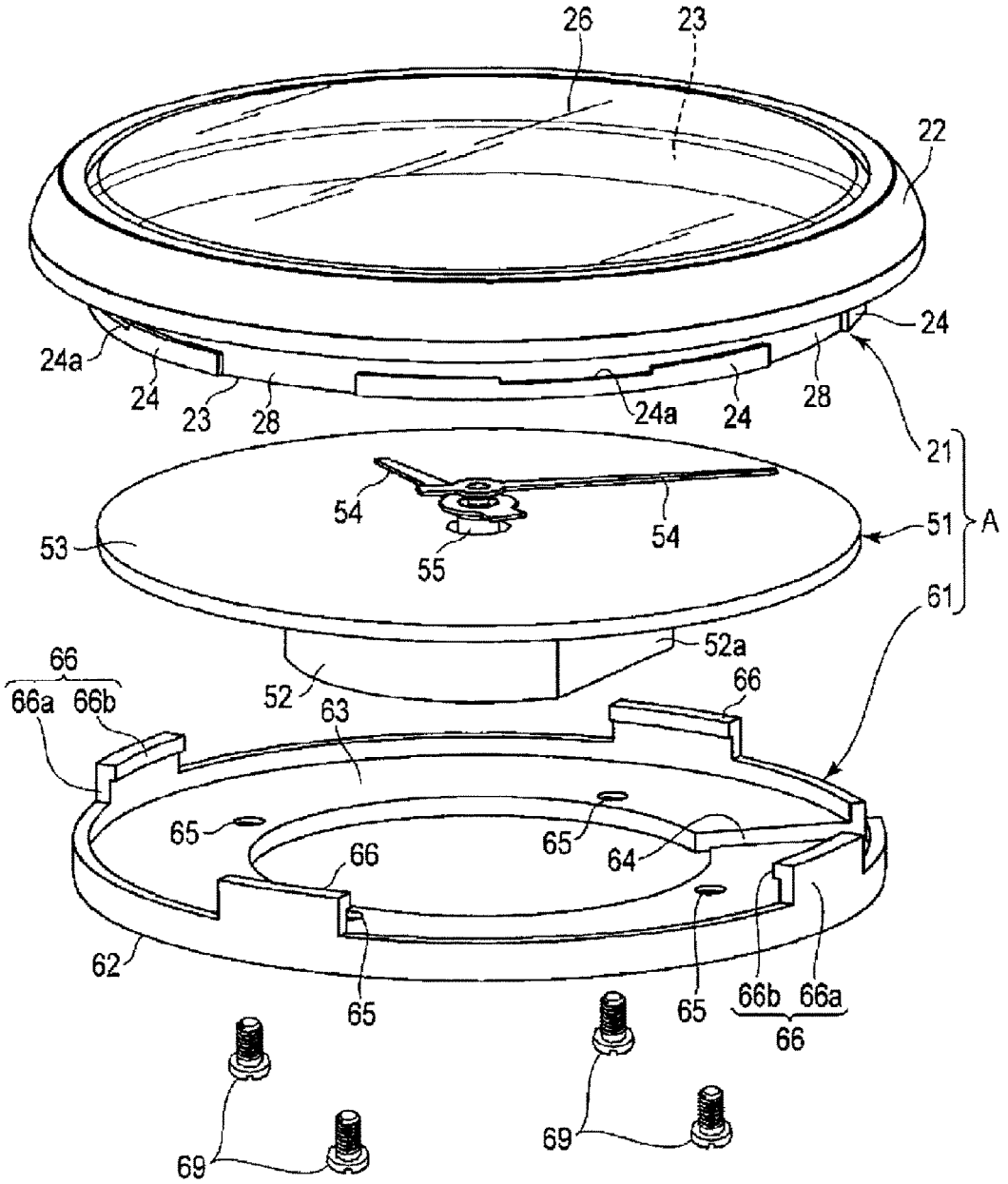
FIG. 4 is an exploded perspective view of the assembly shown in FIG. 3.

The receiving portions 24 protrude, for example, from the outer periphery of the cylindrical portion 23, and, as shown in FIG. 4, etc., are provided at intervals, e.g., at equal intervals, in a plural number in the peripheral direction of the cylindrical portion 23. The intervals between the receiving portions 24 adjacent in the peripheral direction of the cylindrical portion 23 constitute recesses 28 the bottom surfaces of which are formed by the outer peripheral surface of the cylindrical portion 23. The width of the receiving portions 24 extending in the peripheral direction of the cylindrical portion 23 is larger than the width of the recesses 28 extending in the peripheral direction of the cylindrical portion 23. Each receiving portion 24 has an engagement groove 24*a* at a position deviated in the peripheral direction of the edge member 21 with respect to the recess 28. The engagement grooves 24*a* are open on the edge portion 22 side (in other words, the front side of the case 12), and the length thereof is substantially equal to the width of the recesses 28.

The rear surface of the case 12 is in contact with the arm of the user of the wristwatch 11. It is desirable for the case back 31 constituting the rear surface thereof to be formed of metal such as stainless steel or titanium; however, it may also be formed of synthetic resin. As shown in FIGS. 2 and 5, the case back 31 integrally has at the peripheral portion thereof a mounting wall 32 which is of an annular configuration and which is of a smaller diameter than the case back 31. On the outer peripheral surface of the mounting wall 32, there are provided engagement protrusions 33 in the same number as the lock grooves 16 and in the same arrangement as the lock grooves 16. The mounting wall 32 of the case back 31 is inserted into the case band 13 from the rear surface side of the case 12, whereby the case back is mounted to the case band 13 with the engagement protrusions 33 being caught by the lock grooves 16 of the case band 13. Through this mounting, the peripheral portion of the case back 31 is maintained in a state in which it is in contact with the cover receiving surface 13*b* with the waterproof gasket 18 being deformed so as to be compressed.

As shown in FIG. 2, a movement 51 is accommodated in the case 12 along with a casing ring 41.

The casing ring 41 is formed of metal or resin or the like; as shown in FIG. 5, it has a ring-like portion 42, a pair of leg plate portions 43 parallel to each other, and protrusions 44 respectively protruding from these leg plates 43. The inner periphery of the casing ring 41 is formed by the ring-like portion 42 and the pair of leg plate portions 43, and this inner periphery is of a non-circular configuration. The outer periphery of the casing ring 41 is substantially of a circular configuration. The diameter of the outer periphery of the casing ring 41 is substantially the same as the diameter of this inner periphery so that it can be fit-engaged with the inner periphery of the case band bottom portion 14.

The casing ring 41 has a pair of fit-engagement grooves 45 (of which solely one is shown in FIG. 2) on the side of the ring-like portion 42 opposite the side where the leg plate portions 43 protrude.

More specifically, one fit-engagement groove 45 is formed at the portion of the ring-like portion 42 extending between one longitudinal ends of the pair of leg plate portions 43 in an arcuate configuration in conformity with this portion. Similarly, the other fit-engagement groove 45 is formed at the portion of the ring-like portion 42 extending between the other longitudinal ends of the pair of leg plate portions 43 in an arcuate configuration in conformity with this portion. The image of these fit-engagement grooves 45 are depicted in detail in FIG. 9, which illustrates the second embodiment.

Further, as shown in FIG. 5, the casing ring 41 has an escape groove 46 extending from the outer periphery of the ring-like portion 42 to one leg plate portion 43. The protrusion 44 protrudes on the side opposite the ring-like portion 42 with respect to the leg plate portions 43.

The movement 51 has a main body portion 52, and a display panel such as a dial 53. Further, in the first embodiment, the movement 51 also has indicator hands 54 such as an hour hand and a minute hand indicating time.

The main body portion 52 is an operating device; in the wristwatch 11, the indicator hands 54, for example, are moved by this main body portion 52 for time display. This main body portion 52 of the type which uses a small battery or a mainspring as the power source; or of the automatic type; or of the type which performs digital display of time by a quartz oscillation module on the dial 53 (i.e., one for a digital timepiece device); or of the type which uses both the digital timepiece device and some other form. Here, the movement 51 has the indicator hands 54 by way of example.

As shown in FIG. 5, the main body portion 52 has side surfaces 52*a* (solely one of which is shown) parallel to each other, and a pair of arcuate protrusions 52*b*. The arcuate protrusions 52*b* are provided over the pair of side surfaces 52*a*. The portion of the main body portion 52 except for these arcuate protrusions 52*b* is formed in substantially the same configuration as the non-circular inner periphery of the casing ring 41 so that it can be fit-engaged with the inner periphery. Thus, the casing ring 41 and the main body portion 52 that are fit-engaged with each other are set in position so that they may not move in the peripheral direction thereof. The thickness of the arcuate protrusions 52*b* is larger than the thickness of the ring-like portion 42 of the casing ring 41, and these arcuate protrusions 52*b* are formed so as to be capable of being fit-engaged with the fit-engagement groove 45 of the casing ring 41 as the casing ring 41 and the main body portion 52 are fit-engaged with each other.

The main body portion 52 has a hand mounting shaft 55 protruding from the central portion thereof to the exterior of the main body portion 52. The indicator hands 54 are mounted to the hand mounting shaft 55 which is controlled in rotation by the main body portion 52. Of the hour hand, the minute hand, and the second hand, there are employed at least the hour hand and the minute hand as the indicator hands 54.

The dial 53 displaying information e.g., information on time, is circular, and its diameter is larger than that of the main body portion 52; more specifically, it is of a size allowing the peripheral portion of the dial 53 to be brought into contact with the plate receiving surface 23*b* formed at the edge member 21. The hand mounting shaft 55 is passed through a center hole formed at the center of the dial 53, and, in this state, the dial 53 is connected to the main body portion 52 while covering the main body portion 52 from the front side of the case 12.

Figure 3:
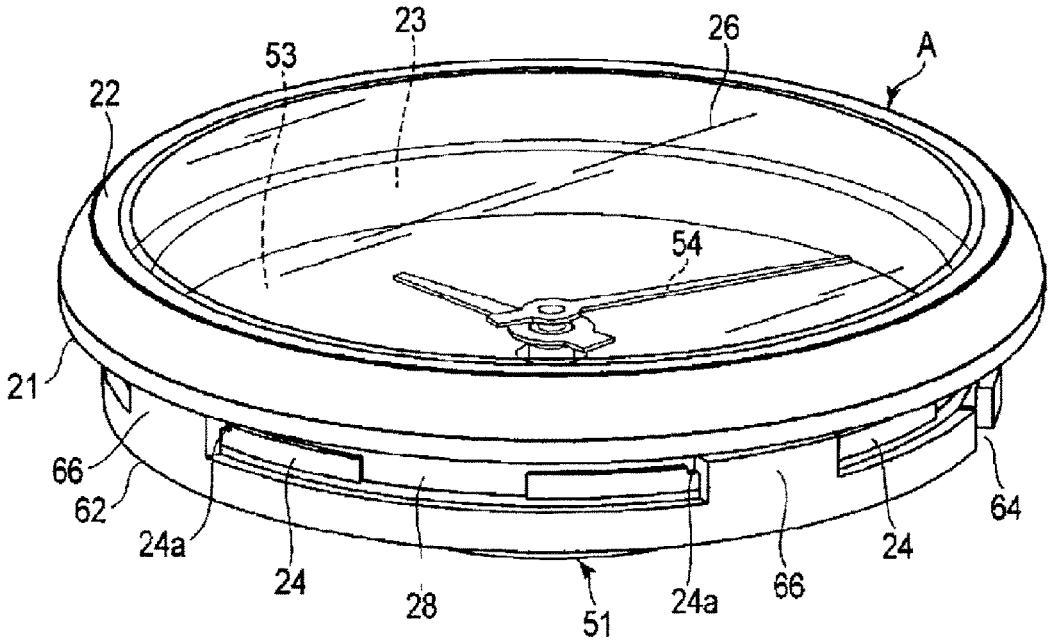
FIG. 3 is a perspective illustrating an assembly mounted to a case band of a first wristwatch.

The surface of the dial 53 is provided with information display; in FIGS. 1, 3, and 4, such display is omitted. The display of the dial 53 is not restricted to a scale indicating time; it may also include a plurality of display regions distinguished from each other in different colors. Alternatively, the display may also include symbols respectively drawn in a plurality of plain display regions (e.g., a sun symbol representing daytime, a moon symbol representing sundown, etc.). Further, not for a timer function, the display may include a directional display allowing simple directional measurement.

Next, a drawing-in mechanism 61 for fixing the edge member 21 to the case band 13 will be described. The drawing-in mechanism 61 is equipped with a drawing-in member 62 and a screw unit for drawing-in such as a screw 69. In the first embodiment, the drawing-in mechanism 61 is arranged within the case 12.

The drawing-in member 62 is formed so as to be equipped with at least a plate portion 63 and an engagement portion 66.

More specifically, as shown in FIG. 2, the plate portion 63 is a portion arranged inside the case band 13 so as to be opposite the rear surface of the dial 53. And, as shown in FIGS. 4 and 5, the plate portion 63 is of a partially cutaway annular configuration having an escape groove 64 between both ends thereof, and has a plurality of screw holes 65 provided in the same number and in the same arrangement as the above-mentioned through-holes 15. As shown in FIG. 2, the screw holes 65 are situated on the inner side of the outer periphery of the dial 53.

As shown in FIGS. 2 and 4, the engagement portions 66 has engagement portions bases 66*a* provided in the same number as the receiving portions 24 and the recesses 28 of the edge member 21 and arranged between the inner peripheral surface 13*c* of the case band 13 and the outer periphery of the dial 53, and hooking portions 66*b* hooked on the receiving portions 24 from the front side of the case 12.

The engagement portion bases 66*a* are of the same arrangement as the receiving portions 24, and are arranged at intervals along the outer periphery of the plate portion 63, protruding from the outer periphery of the plate portion 63 so as to be bent toward the front side of the case 12.

The hooking portions 66*b* are provided so as to slightly protrude toward the center side of the plate portion 63 preferably from the distal end portions of the engagement portion bases 66*a*.

As a result, the thickness of the distal end portions including the hooking portions 66*b* is slightly larger than the thickness of the engagement portion bases 66*a* except for the distal end portions. The maximum thickness of the engagement portions 66 is determined by the distal end portions including the hooking portions 66*b*. In order that the engagement portions 66 may not be a factor to enlarge the diameter of the case 12, this thickness is set to be smaller than the width of the gap between the inner peripheral surface 13*c* of the case band 13 situated on the front side of the case 12 with respect to the case band bottom portion 14 and the outer periphery of the dial 53. More specifically, the thickness of the distal end portions of the engagement portions bases 66*a* including the hooking portions 66*b* is preferably approximately 0.6 mm, and the thickness of the engagement portion bases 66*a* is preferably approximately 0.5 mm; and the protrusion width of the hooking portions 66*b* with respect to the engagement portion bases 66*a* is preferably approximately 0.1 mm.

The width of the hooking portions 66*b* is substantially the same as the width of the recesses 28 of the cylindrical portion 23 and the width of the engagement grooves 24 of the receiving portions 24. The hooking portions 66*b* can pass the recesses 28 in the thickness direction of the case 12, and can be engaged and disengaged with and from the engagement grooves 24*a* from the front side of the case 12.

Inside the case band 13, screws 69 are respectively inserted into the through-holes 15 from the rear surface side toward the front surface side of the case 12, and are respectively threadedly engaged with screw holes 65 of the drawing-in member 62 opposite these through-holes 15. These screws 69 can be detached from the rear surface side of the case 12 in the state in which the case back 31 is removed.

In FIGS. 1 through 5, numeral 71 indicates a crown. Further, in FIG. 5, numeral 72 indicates a winding stem extending through the winding stem passing hole 20. The winding stem 72 protrudes into the case band 13, and passes between an escape groove 46 and an escape groove 64 opposite the same before reaching the main body portion 52 of the movement 51. This winding stem 72 is operated in conjunction with the crown 71; by manually operating the crown 71, the main body portion 52 of the movement 51 is operated via the winding stem 72.

Next, the procedures for assembling the wristwatch 11 according to the first embodiment will be described.

In this assembly, the edge member 21 in which the transparent member 26 has already been mounted to the edge portion 22 through adhesion and in which the waterproof gasket 25 has been fitted into the gasket groove 22*a* of the edge portion 22, the movement 51 assembled so as to have the dial 53 and the indicator hands 54, and the drawing-in member 62 of the drawing-in mechanism 61 are prepared beforehand, and there is formed an assembly A including these as the components (See FIG. 3).

To assemble the assembly A, the edge member 21 supporting the transparent member 26 is first arranged in an attitude in which the transparent member 26 is on the lower side, and the movement 51, which is upside down, is combined therewith from above to attain a state in which the periphery portion of the dial 53 of the movement 51 is in contact with the plate receiving surface 23*b* of the cylindrical portion 23 of the edge member 21. As a result, the dial 53 of the movement 51 is arranged parallel to the transparent member 26 so as to be opposite the transparent member 26.

After this, the drawing-in member 62, which is held upside down so that the engagement portions 66 may face downwards, is placed on the dial 53 from above the movement 51, which is upside down. At the same time, the hooking portions 66*b* of the engagement portions 66 are respectively passed through the recesses 28 formed in the outer peripheral surface of the cylindrical portion 23. As a result, there is attained a state in which the peripheral surface of the dial 53 and the engagement portion bases 66*a* of the engagement portions 66 face each other and in which the drawing-in member 62 covers the dial 53, with the screw hole 65 provided in the plate portion 63 being arranged on the inner side of the outer periphery of the dial 53.

Further, in this state, the drawing-in member 62 is rotated in the peripheral direction thereof. As a result, the hooking portions 66*b* are deviated in the peripheral direction of the cylindrical portion 23 from the recess 28, and the assembly A is assembled in a state in which the hooking portions 66*b* can be hooked on and fit-engaged with the engagement grooves 24*a* of the receiving portions 24 of the edge member 21. The assembly A thus assembled is shown upside down in FIG. 3.

Next, the case band 13 is combined with the assembly A assembled by the above procedures and held upside down.

That is, the case band 13 held upside down so that the edge receiving surface 13*a* may face downwards is put on the portion other than the edge portion 22 of the edge member 21 and the transparent member 26 thereby supported. As a result, the above-mentioned portion is relatively inserted into the case band 13, and the edge receiving surface 13*a* comes into contact with the waterproof gasket 25 mounted to the edge portion 22. At this time, the position of the case band 13 with respect to the assembly A is adjusted such that the through-holes 15 of the case band bottom portion 14 face the screw holes 65 of the plate portion 63 facing the case band bottom portion 14.

In the state in which the case band 13 held upside down is combined with the assembly A thus held upside down, the plate portion 63 of the drawing-in member 62 is arranged below the case band bottom portion 14 of the case band 13 and above the dial 53, and the engagement bases 66*a* of the engagement portions 66 are passed through the gap between the inner peripheral surface 13*c* of the case band 13 and the outer periphery of the dial 53. Further, through the above combination, the main body portion 52 of the movement 51 is passed through the central hole portion of the plate portion 63 of the drawing-in member 62. In this state, there is formed an annular predetermined gap between the main body portion 52 and the inner periphery of the plate portion 63.

Next, the drawing-in mechanism 61 is formed. That is, the screws 69 are respectively passed through the through-holes 15 of the case band bottom portion 14 from above the case band 13 held upside down, and these screws 69 are threaded into the screw holes 65 and are fastened. As a result, the drawing-in member 62 is drawn upwards, and, as the hooking portions 66*b* thereof are fit-engaged with and hooked on the receiving portions 24*a* of the receiving portions 24 from the front side of the case 12, the edge portion 22 of the edge member 21 is drawn so as to be brought into contact with the edge receiving surface 13*a* of the case band 13.

Thus, the waterproof gasket 25 is compressed and held between the edge portion 22 and the edge receiving surface 13*a*, and the edge member 21 is fixed to the case band 13; at the same time, there is maintained the state in which the hooking portions 66*b* are hooked on the engagement grooves 24*a* of the receiving portions 24. At this stage, the case band 13 is upside down, so that the hooking portions 66*b* are fit-engaged with and hooked on the engagement grooves 24*a* from below.

After this, the casing ring 41 is incorporated from above into the case band 13 held upside down, and this casing ring 41 is fit-engaged with the outer periphery of the main body portion 52 of the movement 51. It is also possible to incorporate the casing ring 41 into the case band 13 before the fastening of the screws 69.

Through the incorporation of the casing ring 41, the outer periphery of the casing ring 41 is fit-engaged with the inner periphery of the case band bottom portion 14, and the position of the movement 51 in the radial direction with respect to the case band 13 is determined. At the same time, the incorporated casing ring 41 is set at an appropriate position so as not to move in the peripheral direction with respect to the movement 51, and the fit-engagement groove 45 of the casing ring 41 and the arcuate protrusion 52*b* of the main body portion 52 are fit-engaged in a state in which they are caught in the thickness direction of the case band 13. Further, with the above positioning, the escape groove 46 of the casing ring 41 is mated with the escape groove 64 of the plate portion 63 to form the passage for the winding stem.

Next, the winding stem 72 is passed into the winding stem passing hole 20 of the case band 13, and this winding stem 72 and the movement 51 are connected to each other and, at the same time, the crown 71 is connected to the winding stem 72 from the outside of the case band 13.

Finally, in the state in which the waterproof gasket 18 is fit-engaged with the gasket groove 17 of the case band 13, the mounting wall 32 of the case back 31 is forced into the case band 13 held upside down. Then, at the peripheral portion of the case back 31, the waterproof gasket 18 is compressed and deformed, and, at the same time, the peripheral portion of the case back 31 is brought into contact with the cover receiving surface 13*b* of the case band 13; further, the engagement protrusion 33 of the case back 31 is engaged with the lock groove 16 of the case band bottom portion 14 in a hooked state, whereby the case back 31 is mounted to the case band 13. As a result, the case 12 is assembled, and the assembly of the wristwatch 11 is completed.

In the state in which the assembly has been completed, the peripheral portion of the case back 31 is held in contact with the cover receiving surface 13*b* of the case band 13, and the waterproof gasket 18 is compressed and held between the case back 31 and the case band bottom portion 14. Further, as the case back 31 is mounted, a protrusion 44 of the casing ring 41 is brought into contact with the inner surface of this case back 31, so that the movement 51 is pushed toward the transparent member 26 via the hooking portion of the casing ring 41 and the arcuate protrusion 52*b*. As a result, the peripheral portion of the dial 53 of the movement 51 is pressed against the plate receiving surface 23*b* of the cylindrical portion 23, and the dial 53 is retained by the cylindrical portion 23 of the edge member 21 while supported from the front side of the case 12. At this stage, the case band 13 is upside down, so that the dial 53 is supported from below by the cylindrical portion 23. Also in this state, the contact of the protrusion 44 of the casing ring 41 with respect to the case back 31 is maintained, so that the movement 51 is set in position so that it may not move in the thickness direction of the case band 13.

By the above procedures, the drawing-in mechanism 61 mounting the edge member 21 to the case band 13 and the receiving portion 24 of the edge member 21 are arranged on the rear surface side of the case 12 with respect to the edge portion 22 of the edge member 21. At the same time, the engagement portion bases 66*a* of the engagement portions 66 that the drawing-in member 62 has are arranged between the inner peripheral surface 13*c* of the case band 13 and the outer periphery of the dial 53. Thus, there is formed on the front side of the case 12 with respect to the dial 53 a state in which the hooking portions 66*b* of the engagement portions 66 are hooked on the receiving portion 24 provided in the outer periphery of the cylindrical portion 23 of the edge member 21 from the front side of the case 12. As a result, it is possible to mount the edge member 21 to the case band 13 by fastening the screws 69 as described above.

In the wristwatch 11 assembled by the above procedures, the plate portion 63 of the drawing-in member 62 that the drawing-in mechanism 61 has is arranged so as to face the rear surface of the dial 53, and the screws 69 that the drawing-in mechanism 61 has are arranged on the inner side of the outer periphery of the dial 53. In this way, the screws 69 are not arranged on the outer side of the outer periphery of the dial 53, so that there is no need to provide the edge portion 22 of the edge member 21 with screw holes for receiving the screws 69. Thus, it is possible to reduce a width H of the edge member 21 supporting the transparent member 26.

In this way, it is possible to reduce the width H of the edge member 21, so that, in the case where the diameter size of the case 12 is prescribed, it is possible to increase a display diameter D of the dial 53. Conversely, in the case where the display diameter D of the dial 53 is prescribed, it is possible to diminish the diameter size of the case 12 (the dimension roughly calculated by the formula: D+2H).

In the first embodiment, the engagement portion bases 66*a* of the engagement portions 66 arranged between the inner peripheral surface 13*c* of the case band 13 and the outer periphery of the dial 53 are very small in their thickness, and are provided in the range of a diameter F of the fit-engagement surface 21*a* of the edge member 21 with respect to the case band 13, and more specifically, in the range of a dimension E from the gasket groove 22*a* of the edge member 21 to the inner peripheral surface 23*a* of the cylindrical portion 23. Thus, the thickness of the engagement portion bases 66*a* is negligible as a factor increasing the diameter size of the case 12.

Further, according to the first embodiment, the inner peripheral surface 23*a* of the cylindrical portion 23 that the edge member 21 has is continuous with the peripheral portion of the dial 53 at right angles. As a result, assuming that the case front side opening diameter of the cylindrical portion 23 is the same, it is possible to secure a larger display diameter D of the dial 53 as compared with the construction in which the inner peripheral surface 23*a* of the cylindrical portion 23 is gradually reduced in diameter at it extends toward the rear surface side of the case 12.

In the wristwatch 11 assembled by the above procedures, the hooking portions 66*b* are hooked on the receiving portions 24 while fit-engaged with the engagement grooves 24*a* of the receiving portions 24. Thus, with respect to the drawing-in member 62 held on the case band 13 by the screws 69, the edge member 21 is maintained in a state in which it is arranged at an appropriate position, and this edge member 21 does not inadvertently move in the peripheral direction thereof.

Thus, the hooking between the receiving portions 24 along the thickness direction of the case 12 and the hooking portions 66*b* does not come undone, and there is no fear of the assembly A being dismantled. At the same time, in the case where a display such as a mark is provided at the edge portion 22 of the edge member 21, there is no fear of the display being deviated from the appropriate position in the positional relationship to the dial 53.

Further, in the wristwatch 11 of the first embodiment, the screws 69 are used as the screw unit, so that it is possible to employ inexpensive general-purpose screws as the screw unit. Furthermore, in the wristwatch 11 of the first embodiment, the whole screws 69 are arranged inside the case band 13, and these screws 69 are covered with and hidden by the case back 31 mounted to the case band 13, so that the case rear surface is of a satisfactory outward appearance. At the same time, there is no need to perform on the case back 31 of the case 12 a boring operation to pass the screws 69, and, with this, there is advantageously formed no water intrusion route through the case back 31.

The dismantling of the wristwatch 11 can be performed through procedures reverse to the above-described procedures for assembly. To describe it briefly, with the case back 31 being arranged in an attitude in which it faces upwards, the case back 31 is first removed before removing the casing ring 41. In this case, a tool (not shown) is hooked on a hole 43*a* (See FIG. 5) of the leg plate portion 43 of the casing ring 41 to draw out the casing ring 41. Next, the screws 69 are respectively detached, and then the case band 13 is detached with respect to the assembly A. The detached assembly A is dismantled as needed. In this dismantled state, the waterproof gasket 18 or the waterproof gasket 25 can be replaced as needed.

In the assembly of the wristwatch 11 described above, with the operation of assembling the drawing-in mechanism 61, that is, with the operation of threading the screws 69 into the drawing-in member 62, the edge member 21 is drawn in and fixed to the case band 13. In the dismantling of the wristwatch 11, with the operation of dismantling the drawing-in mechanism 61, that is, with the operation of detaching the screws 69 from the drawing-in member 62, it is possible to detach the edge member 21 from the case band 13.

Thus, even if the assembly or dismantling of the wristwatch 11 is performed in order to perform maintenance such as the replacement of the waterproof gasket 25, no stress is applied to the edge portion of the edge member 21. Thus, even if the assembly and dismantling of the wristwatch 11 are repeated, there is no fear of the edge member 21 and the transparent member 26 being separated from each other. At the same time, in the assembly and dismantling of the wristwatch 11, there is no fear of a tool being inserted between the case band 13 and the edge portion 22 of the edge member 21 to pry open the edge member 21. Thus, even if the assembly and dismantling of the wristwatch 11 are repeated, there is no fear of the edge portion 22 and the case band 13 being damaged. Further, even if the assembly and dismantling of the wristwatch 11 are repeated, there is generated no such wear as will impair the function by which the edge member 21 is fixed to the case band 13, so that the re-assembly after dismantling is of high reliability.

FIGS. 6 through 9 show the second embodiment of the present invention. The wristwatch according to this second embodiment is of the same construction as the first embodiment except for the features described below. Thus, the components that are of the same or a similar construction or of the same function as those of the first embodiment are indicated by the same reference numerals, and a description thereof will be left out. The second embodiment is different from the first embodiment in the cylindrical portion 23, the receiving portions 24, the engagement portions 66, etc.

That is, as shown in FIGS. 6 through 9, in the second embodiment, the outer peripheral surface of the cylindrical portion 23 is formed by a fit-engagement surface 21*a* of the edge member 21. The receiving portions 24 are provided at intervals in the peripheral direction of the cylindrical portion 23 in a plural number. These receiving portions 24 protrude from the cylindrical portion 23 not toward the outer periphery of the cylindrical portion 23 but toward the rear surface side of the case 12, and have receiving portion bases 24*b* and lock portions 24*c*.

Figure 6:
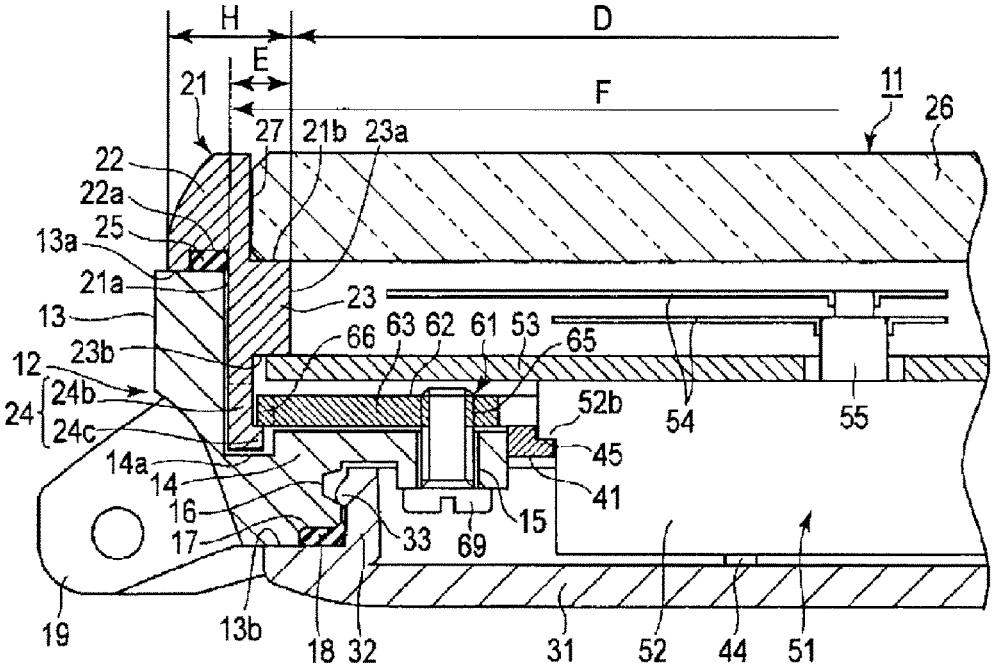
FIG. 6 is a sectional view illustrating a part of a wristwatch according to a second embodiment of the present invention.
Figure 7:
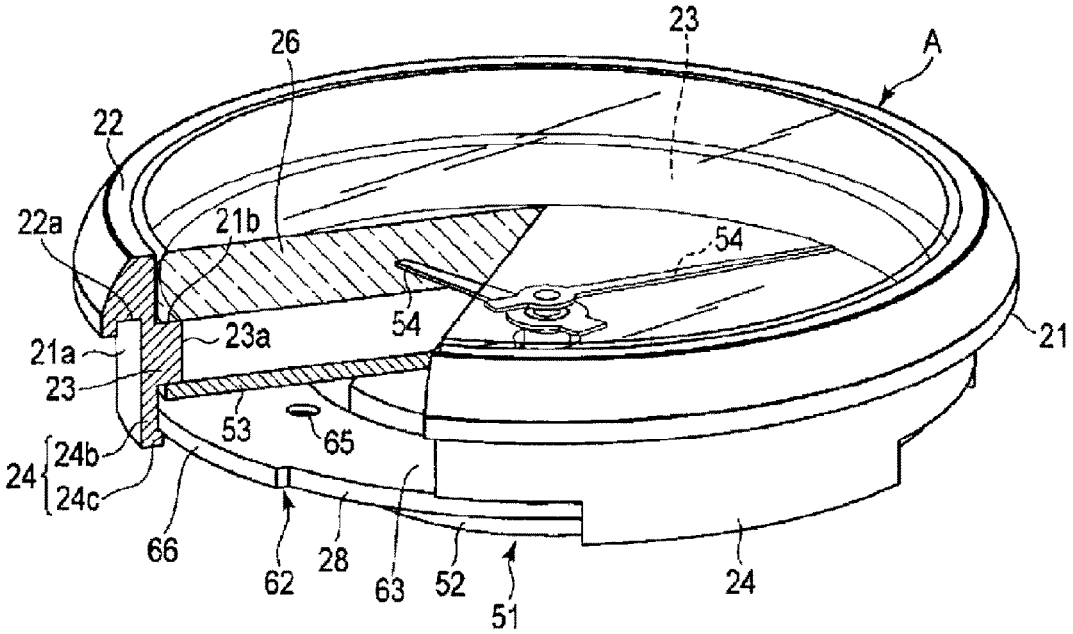
FIG. 7 is a perspective view, partially cutaway, illustrating a part of an assembly mounted to a case band of the wristwatch according to the second embodiment.

As shown in FIGS. 6 and 7, the receiving portion bases 24*b* are portions arranged between the inner peripheral surface 13*c* of the case band 13 and the dial 53, and the outer side surfaces thereof are flush with the fit-engagement surface 21*a*. The lock portions 24*c* are portions formed to protrude inwards at the distal end portions of the receiving portion bases 24*b* so as to be bent inwards. In the second embodiment, the receiving portions 24 of the edge member 21 are not provided with a construction corresponding to the lock grooves described in connection with the first embodiment.

The thickness of the distal end portions of the receiving portions 24 including the lock portions 24*c* is slightly larger than the thickness of the receiving portion bases 24*b* other than the distal end portions. The maximum thickness of the receiving portions 24 including the lock portions 24*c* is determined by the distal end portions. In order that the receiving portions 24 may not be a factor increasing the diameter of the case 12, this thickness is smaller than the width of the gap between the inner peripheral surface 13*c* of the case band 13 situated on the front side of the case 12 with respect to the case band bottom portion 14 and the outer periphery of the dial 53. More specifically, it is preferable that the thickness of the distal end portions of the receiving portion bases 24*b* including the lock portions 24*c* should be approximately 0.6 mm, that the thickness of the receiving portion bases 24*b* should be approximately 0.5 mm, and that the protrusion width of the lock portions 24*c* with respect to the receiving portion bases 24*b* should be approximately 0.1 mm.

Figure 9:
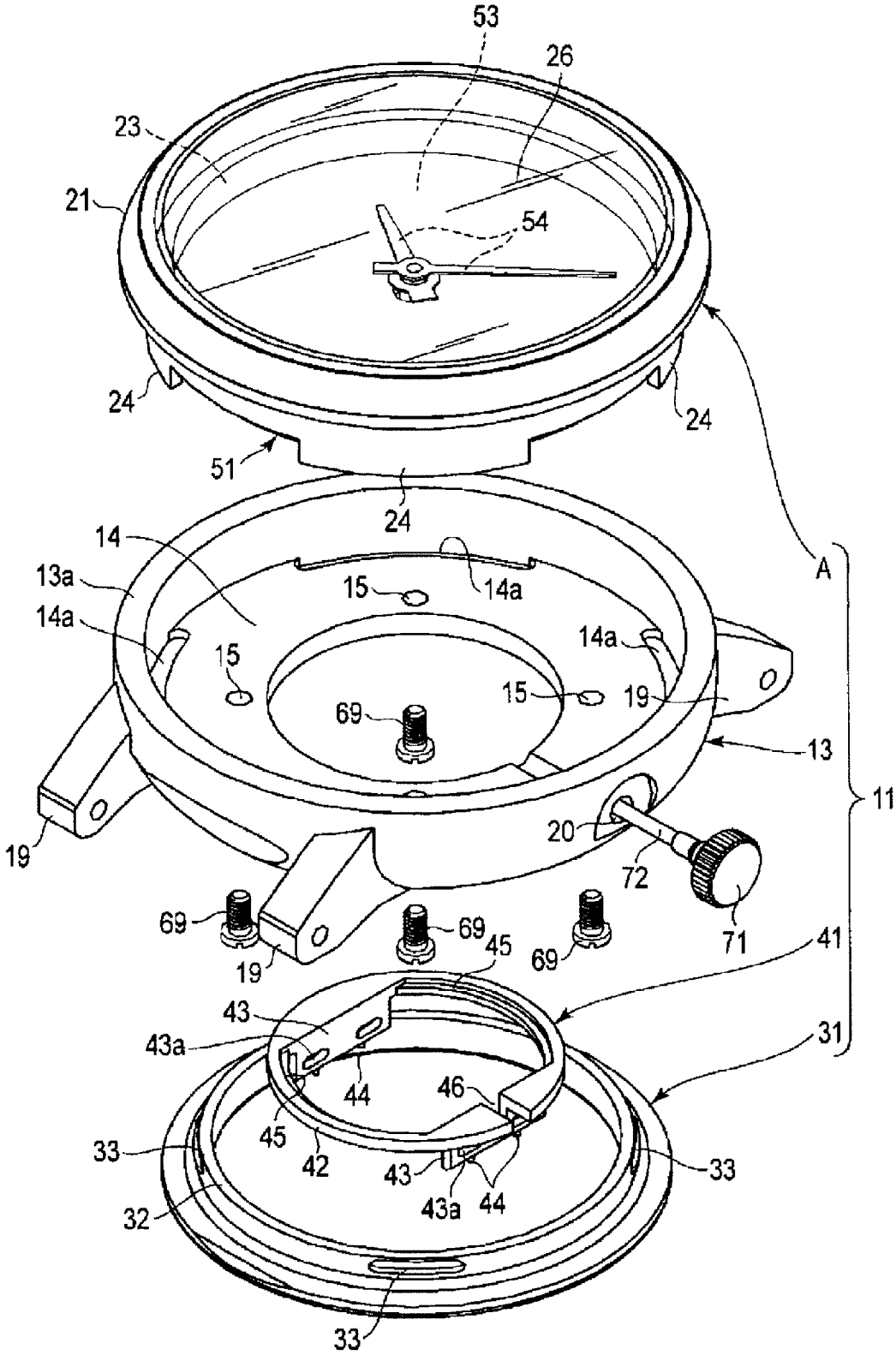
FIG. 9 is an exploded perspective view of the wristwatch according to the second embodiment.

As shown in FIGS. 6 and 9, there are provided, at the base of the case band bottom portion 14 and in the same number as the receiving portions 24, escape recesses 14*a* somewhat larger than the distal end portions of the receiving portions 24 and serving to prevent the distal end portions from coming into contact with the case band bottom portion 14.

Figure 8:
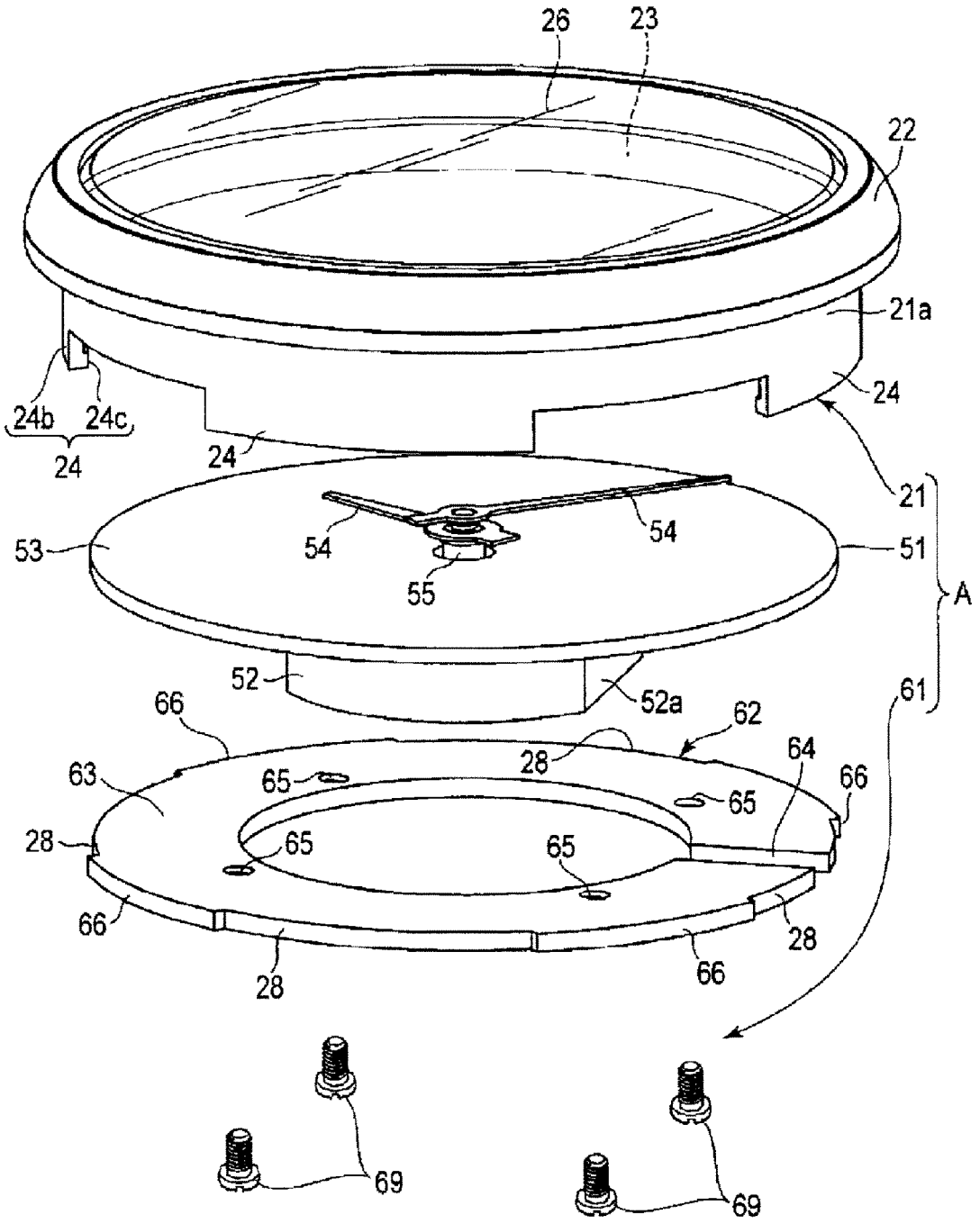
FIG. 8 is an exploded perspective view of the assembly shown in FIG. 7.

As shown in FIG. 8, the engagement portions 66 are provided, at the peripheral portion of the plate portion 63 that the drawing-in member 62 has, at intervals and in the same number as the receiving portions 24. These engagement portions 66 are flush with the plate portion 63, and, at the peripheral portion of the plate portion 63, there are formed recesses 28 including the intervals of the engagement portions 66 adjacent in the peripheral direction. Thus, in the second embodiment, the edge member 21 is not provided with a construction corresponding to the recesses 28. The number of the recesses 28 is the same as the number of the receiving portions 24 and of the engagement portions 66. With respect to these recesses 28, the lock portions 24*c* of the receiving portions 24 can pass in the thickness direction of the case 12.

Apart from the construction described above, this embodiment is of the same construction as the first embodiment including the construction not shown in FIGS. 6 through 9.

Next, the procedures for assembling the wristwatch 11 according to the second embodiment will be described.

In this assembly, the edge member 21 in which the transparent member 26 has already been mounted to the edge portion 22 through adhesion and in which the waterproof gasket 25 has been fitted into the gasket groove 22*a* of the edge portion 22, the movement 51 assembled so as to have the dial 53 and the indicator hands 54, and the drawing-in member 62 of the drawing-in mechanism 61 are prepared beforehand, and there is formed an assembly A including these as the components (See FIG. 7).

To assemble the assembly A, the edge member 21 supporting the transparent member 26 is first arranged in an attitude in which the transparent member 26 is on the lower side, and the movement 51, which is upside down, is combined therewith from above to attain a state in which the peripheral portion of the dial 53 is in contact with the plate receiving surface 23*b* of the cylindrical portion 23 of the edge member 21. As a result, the dial 53 of the movement 51 is arranged parallel to the transparent member 26 so as to be opposite the transparent member 26. In this state, the receiving portions 24 of the edge member 21 is directed upwards (i.e., the rear surface side of the case 12); the receiving portion bases 24*b* of the receiving portions 24 are opposite the peripheral surface of the dial 53, and the lock portions 24*c* of the receiving portions 24 are arranged on the upper side of the dial 53.

After this, the drawing-in member 62 is placed on the dial 53 from above the movement 51, which is upside down. At this time, the lock portions 24*c* formed on the receiving portions 24 of the edge member 21 are respectively passed through the recesses 28 formed at the peripheral portion of the drawing-in member 62. As a result, there is attained a state in which the drawing-in member 62 covers the dial 53, with the screw hole 65 provided in the plate portion 63 being arranged on the inner side of the outer periphery of the dial 53.

Further, in this state, the drawing-in member 62 is rotated in the peripheral direction thereof. As a result, the engagement portions 66 are deviated with respect to the lock portions 24*c* in the peripheral direction of the cylindrical portion 23, and the assembly A is assembled in a state in which the engagement portions 66 and the lock portions 24*c* can hook on each other. FIG. 7 shows the assembly A thus assembled as held upside down.

Next, the case band 13 is combined with the assembly A, which has been assembled by the above procedures and which is held upside down.

That is, the case band 13 is put on the portions other than the edge portion 22 of the edge member 21 and the transparent member 26 thereby supported such that the edge receiving surface 13*a* faces downwards. As a result, the above-mentioned portions are relatively inserted into the case band 13, and the edge receiving surface 13*a* is brought into contact with the waterproof gasket 25 mounted to the edge portion 22. At this time, the position of the case band 13 with respect to the assembly A is adjusted such that the through-holes 15 of the case band bottom portion 14 face the screw holes 65 of the plate portion 63 facing the case band bottom portion 14.

In this way, the case band 13 held upside down is combined with the assembly A held upside down and, in this state, the receiving portion bases 24*b* of the receiving portions 24 are arranged between the inner peripheral surface 13*c* of the case band 13 and the outer periphery of the dial 53. Thus, there is formed on the rear surface side of the case 12 with respect to the dial 53, a state in which the lock portions 24*c* of the receiving portions 24 are hooked, from the rear surface side of the case, on the engagement portions 66 formed at the peripheral portion of the plate portion 63 with which the drawing-in member 62 is equipped. Further, through the above combination, the main body portion 52 of the movement 51 is passed through the central hole portion of the plate portion 63 of the drawing-in member 62. In this state, an annular predetermined gap is formed between the main body portion 52 and the inner periphery of the plate portion 63.

Next, the drawing-in mechanism 61 is formed. That is, from above the case band 13 held upside down, the screws 69 are respectively passed through the through-holes 15 of the case band bottom portion 14, and these screws 69 are threaded into the screw holes 65 and fastened thereto. As a result, the drawing-in member 62 is drawn upwards, and the engagement portions 66 thereof are hooked on the lock portions 24*c* of the receiving portions 24 from the front side of the case and, with this, the edge portion 22 of the edge member 21 is drawn so as to be brought into contact with the edge receiving surface 13*a* of the case band 13.

Thus, the waterproof gasket 25 is compressed and held between the edge portion 22 and the edge receiving surface 13*a*, and the edge member 21 is fixed to the case band 13 and, at the same time, there is maintained a state in which the engagement portions 66 are hooked on the lock portions 24*c* of the receiving portions 24. At this stage, the case band 13 is upside down, so that the engagement portions 66 are hooked on the lock portions 24*c* from below.

After this, the casing ring 41 is incorporated from above into the case band 13 held upside down, and this casing ring 41 is fit-engaged with the outer periphery of the main body portion 52 of the movement 51. The incorporation of the casing ring 41 into the case band 13 may be conducted before the fastening of the screws 69.

Through the incorporation of the casing ring 41, the outer periphery of the casing ring 41 is fit-engaged with the inner periphery of the case band bottom portion 14, and the radial position of the movement 51 with respect to the case band 13 is determined. At the same time, the incorporated casing ring 41 is set in position at an appropriate position so that it may not move with respect to the movement 51 in the peripheral direction thereof, and the fit-engagement groove 45 of the casing ring 41 and the arcuate protrusion 52*b* of the main body portion 52 are fit-engaged with each other in a state in which they are caught in the thickness direction of the case band 13. Further, with the above positioning, the escape groove 46 of the casing ring 41 is mated with the escape groove 64 of the plate portion 63 to form the passage for the winding stem 72.

Next, the winding stem 72 is passed through the winding stem passing hole 20 of the case band 13, and this winding stem 72 and the movement 51 are connected to each other and, at the same time, the crown 71 is connected to the winding stem 72 from the outside of the case band 13.

Finally, in the state in which the waterproof gasket 18 is fit-engaged with the gasket groove 17 of the case band 13, the mounting wall 32 of the case back 31 is forced into the case band 13 held upside down. Then, the waterproof gasket 18 is compressed and deformed at the peripheral portion of the case back 31 and, at the same time, the peripheral portion of the case back 31 is brought into contact with the cover receiving surface 13*b* of the case band 13; further, the engagement protrusion 33 of the case back 31 is engaged with and hooked on the lock groove 16 of the case band bottom portion 14, whereby the case back 31 is mounted to the case band 13. As a result, the case 12 is assembled and, at the same time, the assembly of the wristwatch 11 is completed.

In this state, the peripheral portion of the case back 31 is held in contact with the cover receiving surface 13*b* of the case band 13, and the waterproof gasket 18 is compressed and held between the case back 31 and the case band bottom portion 14. Further, as the case back 31 is mounted, a protrusion 44 of the casing ring 41 comes into contact with the inner surface of this case back 31, so that the movement 51 is pressed toward the transparent member 26 via the hooking portion between the casing ring 41 and the arcuate protrusion 52*b*. As a result, the peripheral portion of the dial 53 of the movement 51 is pressed against the plate receiving surface 23*b* of the cylindrical portion 23, and the dial 53 is supported from the front side of the case 12 by the cylindrical portion 23 of the edge member 21. At this stage, the case band 13 is held upside down, so that the dial 53 is supported from below by the cylindrical portion 23. Also in this state, the contact of the protrusion 44 of the casing ring 41 with the case back 31 is maintained, so that the movement 51 is set in position so that it may not move in the thickness direction of the case band 13.

By the above procedures, the drawing-in mechanism 61 mounting the edge member 21 to the case band 13 and the receiving portions 24 of the edge member 21 are arranged on the rear surface side of the case 12 with respect to the edge portion 22 of the edge member 21. At the same time, the receiving portion bases 24*b* of the receiving portions 24 that the edge member 21 has are arranged between the inner peripheral surface 13*c* of the case band 13 and the outer periphery of the dial 53. Thus, there is formed on the rear surface side of the case 12 with respect to the dial 53 a state in which the engagement portions 66 of the drawing-in member 62 are hooked, from the front side of the case 12, on the lock portions 24*c* of the receiving portions 24 protruding toward the rear surface of the case 12 from the cylindrical portion 23 of the edge member 21. As a result, it is possible to mount the edge member 21 to the case band 13 by fastening the screws 69 as described above.

In the wristwatch 11 assembled by the above procedures, the plate portion 63 of the drawing-in member 62 that the drawing-in mechanism 61 has is arranged opposite the rear surface of the dial 53, and the screws 69 that the drawing-in mechanism 61 has are arranged on the inner side of the outer periphery of the dial 53. In this way, the screws 69 are not arranged on the outer side of the outer periphery of the dial 53, so that there is no need to provide the edge portion 22 of the edge member 21 with screw holes receiving the screws 69. Thus, it is possible to reduce the width H of the edge member 21 supporting the transparent member 26.

In this way, it is possible to reduce the width H of the edge member 21, so that, in the case where the diameter size of the case 12 is prescribed, it is possible to increase the display diameter D of the dial 53. Conversely, in the case where the display diameter D of the dial 53 is prescribed, it is possible to diminish the diameter size of the case 12 (the dimension that can be roughly calculated by the formula: D+2H).

In the second embodiment, the receiving portion bases 24*b* of the receiving portions 24 arranged between the inner peripheral surface 13*c* of the case band 13 and the outer periphery of the dial 53 are very small in their thickness; further, they are provided on the inner side of the diameter F of the fit-engagement surface 21*a* of the edge member 21 with respect to the case band 13, in other words, in the range of the dimension E from the gasket groove 22*a* of the edge member 21 to the inner peripheral surface 23*a* of the cylindrical portion 23. Thus, they are negligible as a factor enlarging the diameter size of the case 12.

Further, according to the second embodiment, the inner peripheral surface 23*a* of the cylindrical portion 23 that the edge member 21 has is continuous with the peripheral portion of the dial 53 at right angles. As a result, assuming that the case front surface side opening diameter of the cylindrical portion 23 is the same, it is possible to secure a larger display diameter D of the dial 53 as compared with the construction in which the inner peripheral surface 23*a* of the cylindrical portion 23 is gradually reduced in diameter as it extends toward the rear surface side of the case 12.

In the wristwatch 11 according to the second embodiment assembled by the above procedures, the screws 69 are used as the screw unit, so that it is possible to employ inexpensive general-purpose screws as the screw unit. Further, in the wristwatch 11 of the second embodiment, the whole screws 69 are arranged inside the case band 13, and these screws 69 are covered with and hidden by the case back 31 mounted to the case band 13, so that the case rear surface is of a satisfactory outward appearance. At the same time, there is no need to perform a boring operation on the case back 31 of the case 12 to pass the screws 69, and, with that, there is advantageously formed no intrusion route for water passing through the case back 31.

The dismantling of the wristwatch 11 is conducted by procedures reverse to the assembly procedures described above. To describe it briefly, first, in the state in which the case back 31 is arranged in an attitude facing upwards, the case back 31 is detached, and then the casing ring 41 is detached. In this case, a tool (not shown) is hooked on a hole 43*a* that the leg plate portion 43 of the casing ring 41 has (See FIG. 9), and the casing ring 41 is drawn out. Next, the screws 69 are respectively detached, and then the case band 13 is detached with respect to the assembly A. The assembly A detached is dismantled as needed. And, in this dismantled state, it is possible to replace the waterproof gasket 18 or the waterproof gasket 25 as needed.

In the assembly of the wristwatch 11 described above, with the operation of assembling the drawing-in mechanism 61, that is, with the operation of threading the screws 69 into the drawing-in member 62, the edge member 21 is drawn in, and fixed to the case band 13. In the dismantling of the wristwatch 11, with the operation of dismantling the drawing-in mechanism 61, that is, with the operation of detaching the screws 69 from the drawing-in member 62, there is attained a state in which it is possible to detach the edge member 21 from the case band 13.

Thus, when performing maintenance such as the replacement of the waterproof gasket 25, no stress is applied to the edge portion of the edge member 21 even if the assembly or dismantling of the wristwatch 11 is performed. Thus, even if the assembly and dismantling of the wristwatch 11 are repeated, there is no fear of the edge member 21 and the transparent member 26 being separated from each other. At the same time, in the assembly and dismantling of the wristwatch 11, there is no fear of a tool being inserted between the case band 13 and the edge portion 22 of the edge member 21 to pry open the edge member 21. Thus, even if the assembly and dismantling of the wristwatch 11 are repeated, there is no fear of the edge portion 22 and the case band 13 being damaged. Further, even if the assembly and dismantling of the wristwatch 11 are repeated, there is generated no such wear as will impair the function by which the edge member 21 is fixed to the case band 13, so that the re-assembly after dismantling is of high reliability.

FIGS. 10 through 13 show the third embodiment of the present invention. Except for what is described below, the wristwatch of the third embodiment is of the same construction as that of the first embodiment. Thus, the components that are the same as or similar to or of the same function as those of the wristwatch 11 according to the first embodiment are indicated by the same reference numerals, and a description thereof will be left out. The third embodiment differs from the first embodiment in the case band bottom portion, the drawing-in mechanism, etc.

That is, as shown in FIGS. 10 through 13, in the third embodiment, the case band bottom portion 14 has a fit-engagement hole 14*b* which extends through it in the thickness direction and which constitutes the inner peripheral surface of the case band bottom portion 14. To prevent the drawing-in member 62 from rotating in the peripheral direction thereof, the fit-engagement hole 14*b* is formed as a non-circular, e.g., rectangular hole, more specifically, a substantially hexagonal hole all the angles of which are beveled. In the third embodiment, the case band bottom portion 14 is provided with no through-holes and lock grooves described in connection with the first embodiment. Further, the cover receiving surface 13*b* of the third embodiment is formed not by the end surface on the case rear surface side in the thickness direction of the case band 13 but by the rear surface of the case band bottom portion 14 provided with a step with respect to this end surface.

Figure 12:
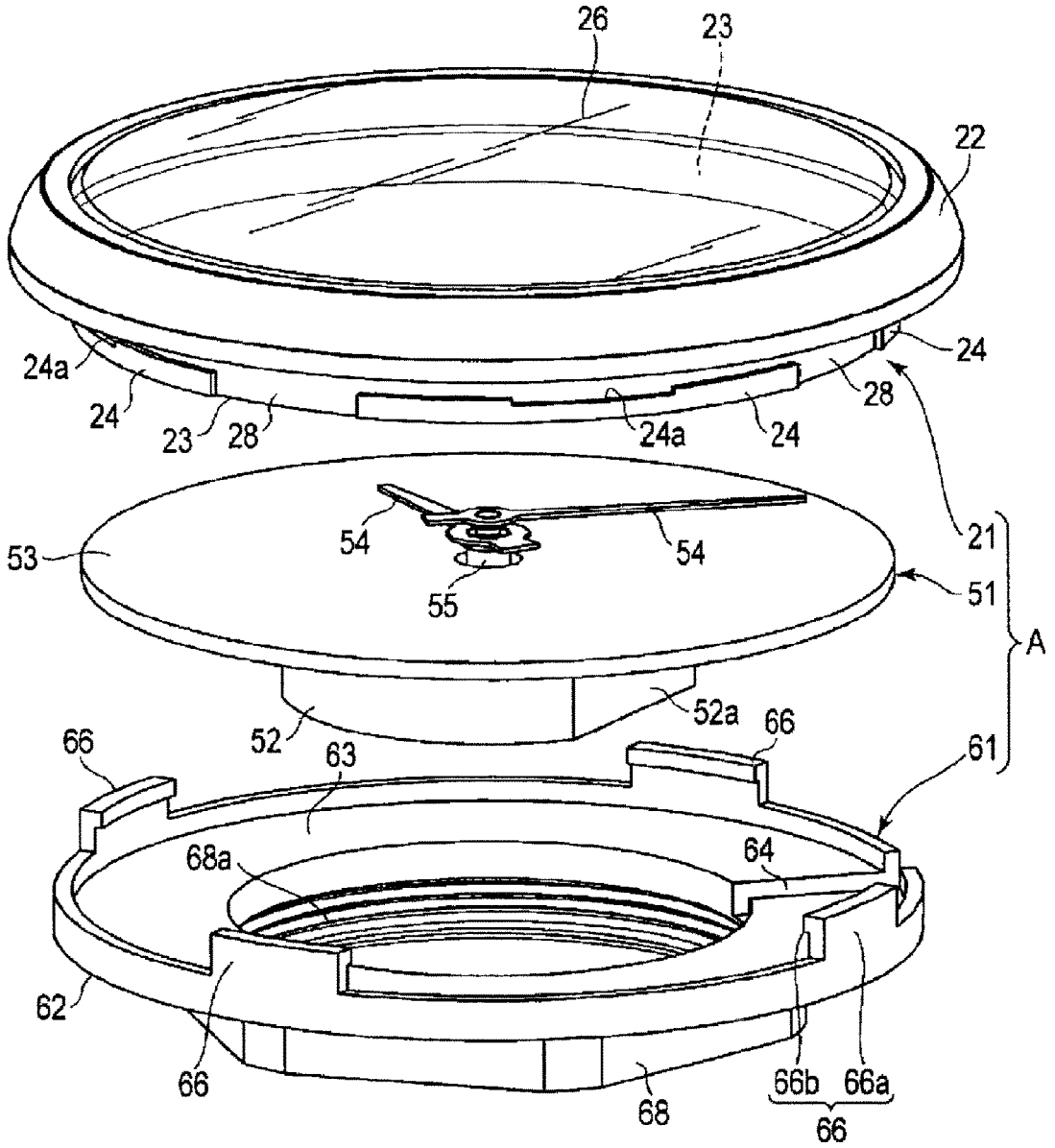
FIG. 12 is an exploded perspective view of the assembly shown in FIG. 11.
Figure 13:
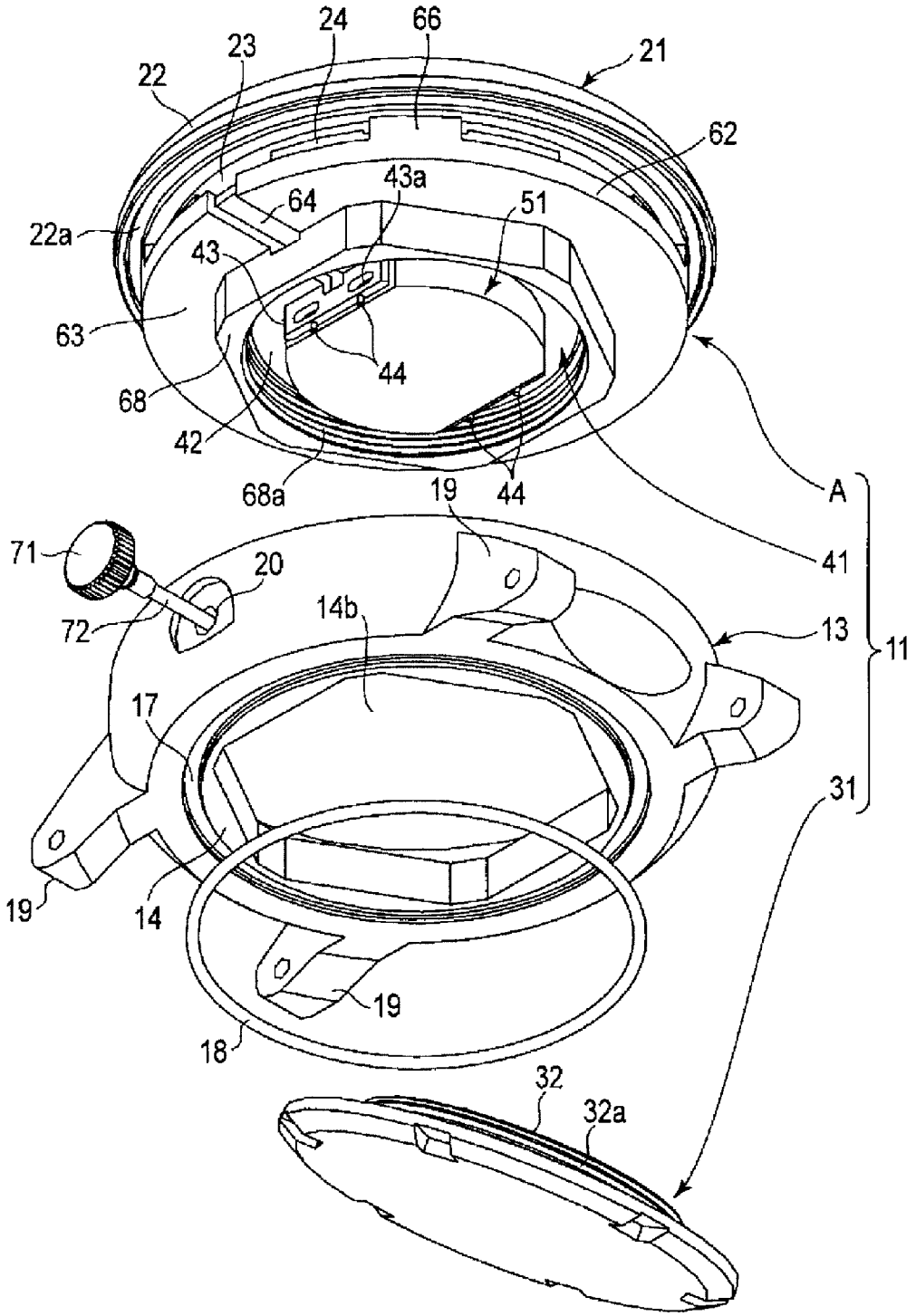
FIG. 13 is an exploded perspective view of the wristwatch according to the third embodiment.

As shown in FIGS. 12, 13, etc., the drawing-in member 62 with which the drawing-in mechanism 61 is equipped has an annular tubular portion 68 protruding integrally from the inner peripheral portion of the plate portion 63 thereof toward the rear surface side of the case 12. The annular tubular portion 68 is a portion fit-engaged with the fit-engagement hole 14*b* so as to allow insertion and detachment. The external configuration of the annular tubular portion 68 is in correspondence with the configuration of the fit-engagement hole 14*b*; in the case of the third embodiment, it is substantially of a hexagonal configuration all the angles of which are beveled. A female screw portion 68*a* is formed on the inner peripheral surface of this annular tubular portion 68.

Figure 10:
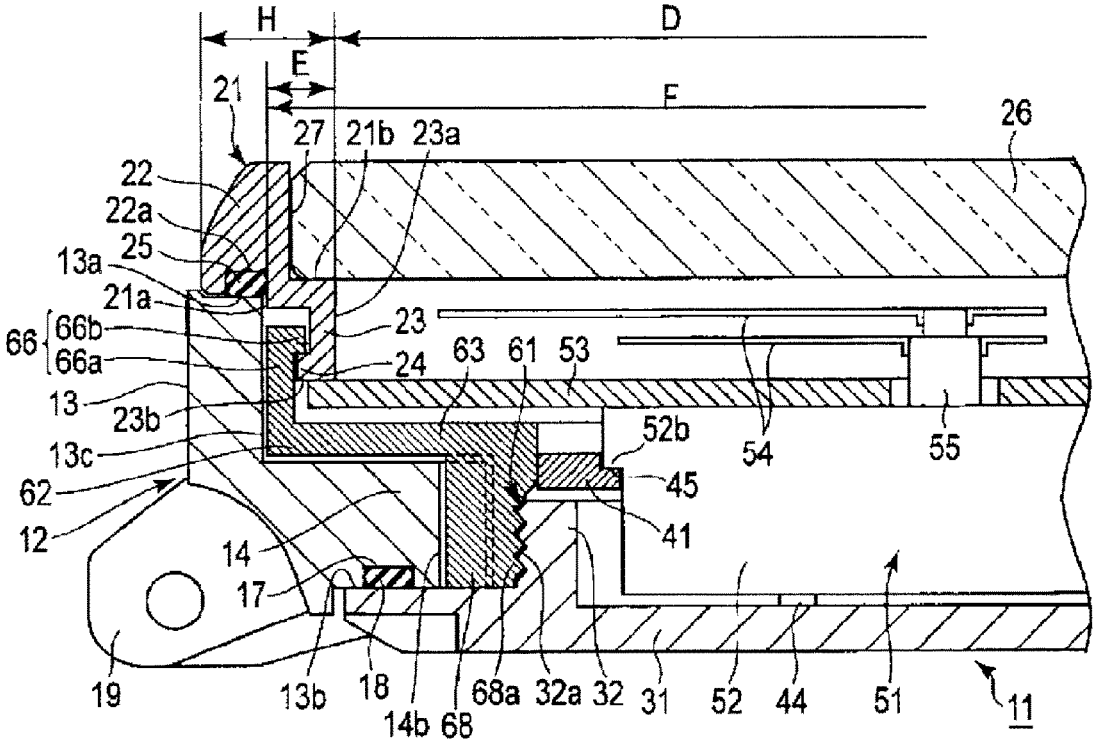
FIG. 10 is a sectional view illustrating a part of a wristwatch according to a third embodiment of the present invention.

In the third embodiment, the screw unit that the drawing-in mechanism 61 has is provided on the case back 31. That is, as shown in FIGS. 10 and 13, the screw unit is formed by a male screw portion 32*a* provided on the outer peripheral surface of the mounting wall 32 that the case back 31 has. This male screw portion 32*a* serves as a means for mounting the case back 31 to the case band 13, and is threadedly engaged with the female screw portion 68*a* of the annular tubular portion 68. Thus, in the third embodiment, the mounting wall 32 is not provided with the engagement protrusion described in connection with the first embodiment.

Apart from the construction described above, this embodiment is the same as the first embodiment including the construction not shown in FIGS. 10 through 13.

Next, the procedures for assembling the wristwatch 11 according to the third embodiment will be described.

Figure 11:
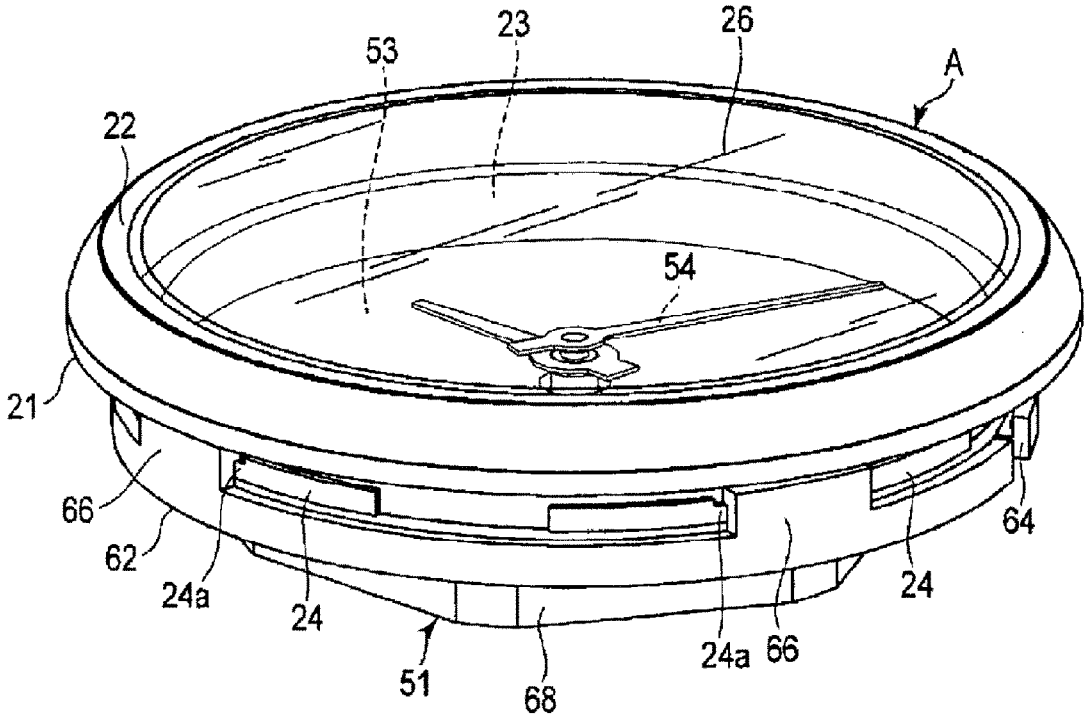
FIG. 11 is a perspective view of an assembly mounted to a case band of the wristwatch according to the third embodiment.

In this assembly, the edge member 21 in which the transparent member 26 has already been mounted to the edge portion 22 through adhesion and in which the waterproof gasket 25 has been fitted into the gasket groove 22*a* of the edge portion 22, the movement 51 assembled so as to have the dial 53 and the indicator hands 54, and the drawing-in member 62 of the drawing-in mechanism 61 are prepared beforehand, and there is formed an assembly A including these as the components (See FIG. 11).

To assemble the assembly A, the edge member 21 supporting the transparent member 26 is first arranged in an attitude in which the transparent member 26 is on the lower side, and the movement 51, which is upside down, is combined therewith from above to attain a state in which the peripheral portion of the dial 53 is in contact with the plate receiving surface 23*b* of the cylindrical portion 23 of the edge member 21. As a result, the dial 53 of the movement 51 is arranged parallel to the transparent member 26 so as to be opposite the transparent member 26.

After this, the drawing-in member 62, which is held upside down so that the engagement portions 66 may face downwards, is placed on the dial 53 from above the movement 51, which is upside down. At the same time, the hooking portions 66*b* of the engagement portions 66 are respectively passed through the recesses 28 formed in the outer peripheral surface of the cylindrical portion 23. As a result, there is attained a state in which the peripheral surface of the dial 53 and the engagement portion bases 66*a* of the engagement portions 66 face each other and in which the drawing-in member 62 covers the dial 53, with the annular tubular portion 68 protruding from the plate portion 63 thereof being arranged on the inner side of the outer periphery of the dial 53.

Further, in this state, the drawing-in member 62 is rotated in the peripheral direction thereof. As a result, the hooking portions 66*b* are deviated in the peripheral direction of the cylindrical portion 23 from the recesses 28, and the assembly A is assembled in a state in which the hooking portions 66*b* can be hooked on and fit-engaged with the engagement grooves 24*a* of the receiving portions 24 of the edge member 21. The assembly A thus assembled is shown upside down in FIG. 11.

Next, the case band 13 is combined with the assembly A assembled by the above procedures and held upside down.

That is, the case band 13 held upside down so that the edge receiving surface 13*a* may face downwards is put on the portion other than the edge portion 22 of the edge member 21 and the transparent member 26 thereby supported. As a result, the above-mentioned portion is relatively inserted into the case band 13, and the edge receiving surface 13*a* comes into contact with the waterproof gasket 25 mounted to the edge portion 22.

In the state in which the case band 13 held upside down is combined with the assembly A thus held upside down, the plate portion 63 of the drawing-in member 62 is arranged below the case band bottom portion 14 of the case band 13 and above the dial 53, and the engagement bases 66*a* of the engagement portions 66 are passed through the gap between the inner peripheral surface 13*c* of the case band 13 and the outer periphery of the dial 53. Further, through the above combination, the main body portion 52 of the movement 51 is passed through the central hole portion of the plate portion 63 of the drawing-in member 62. In this state, there is formed an annular predetermined gap between the main body portion 52 and the inner periphery of the plate portion 63.

Further, in the state in which the assembly A held upside down and the case band 13 are combined as described above, the annular tubular portion 68 of the drawing-in member 62 is fit-engaged with the fit-engagement hole 14*b* of the case band bottom portion 14. Through this fit-engagement, the case band 13 and the drawing-in member 62 are set in position with respect to each other, and are prevented from rotating in the peripheral direction thereof.

After this, the casing ring 41 is incorporated from above into the case band 13 held upside down, and this casing ring 41 is fit-engaged with the outer periphery of the main body portion 52 of the movement 51 and, at the same time, is also fit-engaged with the inner periphery of the annular tubular portion 68. The incorporation of the casing ring 41 into the case band 13 may be conducted before the case band 13 is put on the assembly A.

Through the incorporation of the casing ring 41, the outer periphery of the casing ring 41 is fit-engaged with the inner periphery of the case band bottom portion 14, and the position of the movement 51 in the radial direction with respect to the case band 13 is determined. At the same time, the incorporated casing ring 41 is set at an appropriate position so as not to move in the peripheral direction with respect to the movement 51, and the fit-engagement groove 45 of the casing ring 41 and the arcuate protrusion 52*b* of the main body portion 52 are fit-engaged in a state in which they are caught in the thickness direction of the case band 13. Further, with the above positioning, the escape groove 46 of the casing ring 41 is mated with the escape groove 64 of the plate portion 63 to form the passage for the winding stem.

In this state, the winding stem 72 is passed into the winding stem passing hole 20 of the case band 13, and this winding stem 72 and the movement 51 are connected to each other and, at the same time, the crown 71 is connected to the winding stem 72 from the outside of the case band 13.

Next, the drawing-in mechanism 61 is formed, and the case back 31 is mounted to the case band 13. That is, in the state in which the waterproof gasket 18 is fit-engaged with the gasket groove 17 of the case band 13 held upside down, the mounting wall 32 is inserted, while rotating the case back 31, into the annular tubular portion 68 that the drawing-in member 62 has, from above the case band 13. As a result, the male screw portion 68*a* formed in the outer periphery of the mounting wall 32 is threadedly engaged with the female screw portion 32*a* of the annular tubular portion 68. This fastening of the case back 31 is possible since the drawing-in member 62 is prevented from rotating as described above.

Through the operation of fastening the case back 31 described above, the drawing-in member 62 is drawn upwards, and the hooking portions 66*b* thereof are caught to be fit-engaged with the receiving portions 24*a* of the receiving portions 24 from the front side of the case 12. At the same time, the edge portion 22 of the edge member 21 is drawn so as to be brought into contact with the edge receiving surface 13*a* of the case band 13.

Thus, the waterproof gasket 25 already fit-engaged with the edge member 21 is compressed, and is held between the edge portion 22 and the edge receiving surface 13*a*; in this state, the edge member 21 is fixed to the case band 13 and, at the same time, the state is maintained in which the hooking portions 66*b* are hooked on the engagement grooves 24*a* of the receiving portions 24. At this stage, the case band 13 is upside down, so that the hooking portions 66*b* are hooked on and fit-engaged with the engagement grooves 24*a* from below.

At the same time, the case back 31 is drawn to the case band 13, and the waterproof gasket 18 held between the peripheral portion of the case back 31 and the cover receiving surface 13*b* is compressed, and the case back 31 is mounted to the case band 13. As described above, as the case back 31 is threaded into the drawing-in member 62 to mount the case back 31, the edge member 21 is mounted to the case band 13, and the case 12 is assembled.

And, as the case back 31 is mounted to the case band 13, the protrusion 44 of the casing ring 41 comes into contact with the inner surface of the case back 31, so that there is attained a state in which the movement 51 is pressed toward the transparent member 26 via the hooking portion between the casing ring 41 and the arcuate protrusion 52*b*. As a result, the peripheral portion of the dial 53 of the movement 51 is pressed against the plate receiving surface 23*b* of the cylindrical portion 23, and the dial 53 is supported by the cylindrical portion 23 of the edge member 21 from the front side of the case 12. At this stage, the case band 13 is upside down, so that the dial 53 is supported by the cylindrical portion 23 from below. Also in this state, the contact of the protrusion 44 of the casing ring 41 with the case back 31 is maintained, so that the movement 51 is set in position so that it may not move in the thickness direction of the case band 13.

In the wristwatch 11 assembled by the above procedures, the drawing-in mechanism 61 mounting the edge member 21 to the case band 13 and the receiving portions 24 of the edge member 21 are arranged on the rear surface side of the case 12 with respect to the edge portion 22 of the edge member 21. And, the engagement portion bases 66*a* of the engagement portions 66 that the drawing-in member 62 has are arranged between the inner peripheral surface 13*c* of the case band 13 and the outer periphery of the dial 53. Thus, there is formed, on the front side of the case 12 with respect to the dial 53, a state in which the hooking portions 66*b* of the engagement portions 66 are hooked on the receiving portions 24 provided in the outer periphery of the cylindrical portion 23 of the edge member 21 from the front side of the case 12.

In the wristwatch 11 assembled by the above procedures, the plate portion 63 of the drawing-in member 62 that the drawing-in mechanism 61 has is arranged opposite the rear surface of the dial 53, and, at the same time, the annular tubular portion 68 having the female screw portion 68*a* threadedly engaged with the male screw portion 32*a* which is the screw unit of the drawing-in mechanism 61 is arranged on the inner side of the outer periphery of the dial 53. In this way, the annular tubular portion 68 having the female screw portion 68*a* is not arranged on the outer side of the outer periphery of the dial 53, so that there is no need to provide a screw hole in the edge portion 22 of the edge member 21. Thus, it is possible to reduce the width H of the edge member 21 supporting the transparent member 26.

In this way, it is possible to reduce the width H of the edge member 21, so that, in the case where the diameter size of the case 12 is prescribed, it is possible to increase the display diameter D of the dial 53. Conversely, in the case in which the display diameter D of the dial 53 is prescribed, it is possible to diminish the diameter size of the case 12 (a dimension to be roughly calculated by the formula: D+2H).

In the third embodiment, the engagement portion bases 66*a* of the engagement portions 66 arranged between the inner peripheral surface 13*c* of the case band 13 and the outer periphery of the dial 53 are very small in their thickness, and are provided in the range of the diameter F of the fit-engagement surface 21*a* of the edge member 21 with respect to the case band 13; in other words, they are provided in the range of the dimension E from the gasket groove 22*a* of the edge member 21 to the inner peripheral surface 23*a* of the cylindrical portion 23. Thus, the thickness of the engagement portion bases 66*a* is negligible as a factor increasing the diameter size of the case 12.

Further, according to the third embodiment, the inner peripheral surface 23*a* of the cylindrical portion 23 that the edge member 21 has is continuous with the peripheral portion of the dial 53 at right angles, so that, for the same reason as described above in connection with the first embodiment, it is possible to secure a larger display diameter D of the dial 53.

In the wristwatch 11 assembled by the above procedures, the hooking portions 66*b* are hooked on the receiving portions 24 while fit-engaged with the engagement grooves 24*a* of the receiving portions 24. Thus, for the same reason as described in connection with the first embodiment, there is no fear of the assembly A being dismantled. At the same time, in the case where a display such as a mark is provided at the edge portion 22 of the edge member 21, there is no fear of that display being deviated from the appropriate position in the positional relationship with the dial 53.

In the wristwatch 11 according to the third embodiment, the mounting wall 32 of the case back 31 is utilized as the screw unit, and the male screw portion 32*a* is provided in the outer periphery thereof. Thus, a plurality of screws is not used, so that it is possible to reduce the number of components and the assembly man-hours. Further, in the wristwatch 11 of the third embodiment, the male screw portion 32*a* as the screw unit is covered with and hidden by the case back 31, so that the case rear surface is of a satisfactory outward appearance, and there is no need to perform boring to pass a screw through the case back 31; in addition, there is advantageously formed no intrusion route for water passing through the case back 31.

The dismantling of the wristwatch 11 is conducted by procedures reverse to the assembly procedures described above. To describe it briefly, first, in the state in which the case back 31 is arranged to face upwards, the case back 31 is detached, and then, the casing ring 41 is detached. In this case, a tool (not shown) is hooked on a hole 43*a* (See FIG. 5) that the leg plate portion 43 of the casing ring 41 has, and the casing ring 41 is drawn out. Next, the screws 69 are respectively detached, and then the case band 13 is detached with respect to the assembly A. The assembly A detached is dismantled as needed. And, in the dismantled state, it is possible to replace the waterproof gasket 18 or the waterproof gasket 25 as needed.

In the assembly of the wristwatch 11 described above, with the operation of assembling the drawing-in mechanism 61, that is, with the operation of threading the screws 69 into the drawing-in member 62, the edge member 21 is drawn in and fixed to the case band 13. In the dismantling of the wristwatch 11, with the operation of dismantling the drawing-in mechanism 61, that is, with the operation of detaching the screws 69 from the drawing-in member 62, it becomes possible to detach the edge member 21 from the case band 13.

Thus, when performing maintenance such as the replacement of the waterproof gasket 18, even if the assembly or dismantling is performed, no stress is applied to the edge portion of the edge member 21. Thus, even if the assembly and dismantling of the wristwatch 11 are repeated, there is no fear of the edge member 21 and the transparent member 26 from being separated from each other. At the same time, in the assembly and dismantling of the wristwatch 11, there is no fear of a tool being inserted between the case band 13 and the edge portion 22 of the edge member 21 to pry open the edge member 21. Thus, even if the assembly and dismantling of the wristwatch 11 are repeated, there is no fear of the edge portion 22 and the case band 13 being damaged. Further, even if the assembly and dismantling of the wristwatch 11 are repeated, there is generated no such wear as will impair the function by which the edge member 21 is fixed to the case band 13, so that the re-assembly after dismantling is of high reliability.

Figure 14:
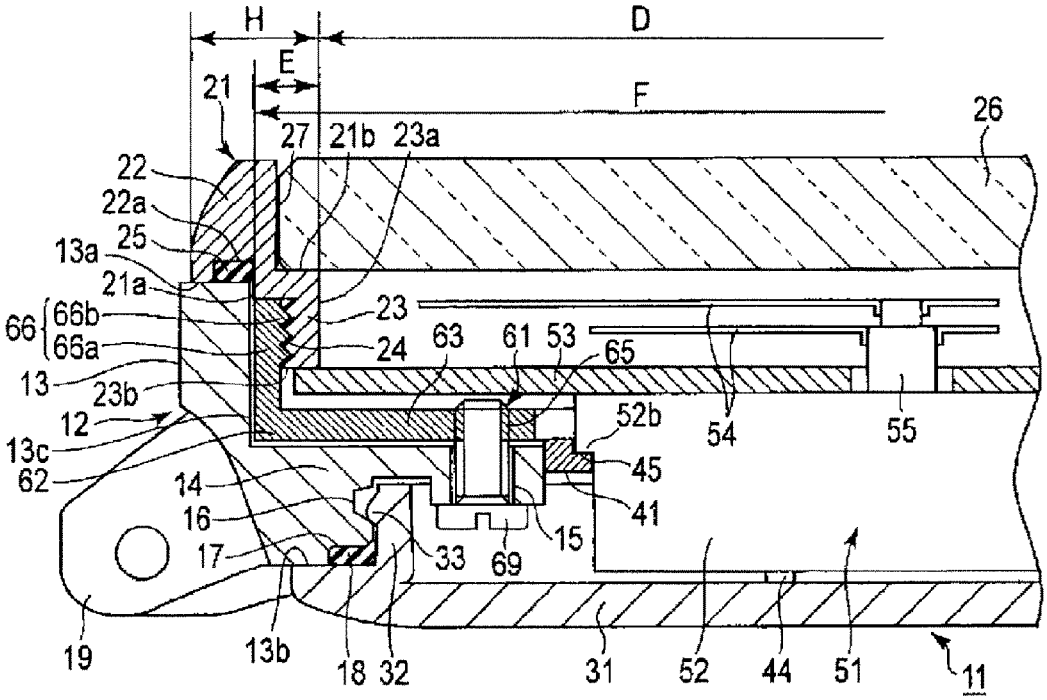
FIG. 14 is a sectional view illustrating a part of a wristwatch according to a fourth embodiment of the present invention.

FIG. 14 shows the fourth embodiment of the present invention. The wristwatch according to this fourth embodiment is of the same construction as the first embodiment except for what is described below. Thus, the components that are the same as or similar to or of the same function as those of the first embodiment are indicated by the same reference numerals as those of the first embodiment, and a description thereof will be left out. The fourth embodiment differs from the first embodiment in the receiving portions and the hooking portions.

That is, in the outer periphery of the cylindrical portion 23 that the edge member 21 has, there are formed a plurality of receiving portions 24 in the thickness direction of the case 12. More specifically, in the third embodiment, the receiving portions 24 are formed by male screw portions provided in the outer periphery of the cylindrical portion 23. As the receiving portions 24, there may be formed recesses and protrusions parallel to each other in the outer periphery of the cylindrical portion 23. In this case, there are provided, in the peripheral direction of the cylindrical portion 23, a plurality of recesses dividing the recesses and protrusions as the receiving portions 24 into a plurality of regions extending in the peripheral direction of the cylindrical portion 23 (These recesses correspond to the recesses 28 described in connection with the first embodiment).

Also the hooking portions 66*b* that the drawing-in member 62 has are formed in the thickness direction of the case 12 in a plural number. More specifically, in the fourth embodiment, the hooking portions 66*b* are formed by female screw portions provided in the inner periphery of the distal end portions of the engagement portion bases 66*a*. As the hooking portions 66*b*, recesses and protrusions parallel to each other may be formed in the inner periphery of the distal end portions of the engagement portion bases 66*a*. In this case, the engagement portion bases 66*a* are formed in the same number as the recesses, and at the same time, the hooking portions 66*b* are formed so as to be capable of passing these recesses in the thickness direction of the case 12.

And, the receiving portions 24 provided in the outer periphery of the cylindrical portion 23 and the hooking portions 66*b* provided on the drawing-in member 62 are, for example, respectively threadedly engaged, and are hooked on each other in the thickness direction of the case 12 as shown in FIG. 14.

Apart from what has been described above, this embodiment is of the same construction as the first embodiment including the construction not shown in FIG. 14.

In the wristwatch 11 according to the fourth embodiment, it is possible to provide a wristwatch 11 in which the width H of the edge member 21 supporting the transparent member 26 is small for the same reason as described in connection with the first embodiment, and, at the same time, it is possible to achieve all the effects of the embodiment described in connection with the first embodiment. In addition, in the wristwatch 11 according to the fourth embodiment, the receiving portions 24 and the hooking portions 66*b* are hooked on each other at a plurality of positions in the thickness direction of the case 12, whereby, even if the protrusion width of the receiving portions 24 and the hooking portions 66*b* is small, it is possible to enhance the reliability of this hooking. Thus, it is possible to perform more reliably the mounting of the edge member 21 to the case band 13 by the drawing-in mechanism 61.

Figure 15:
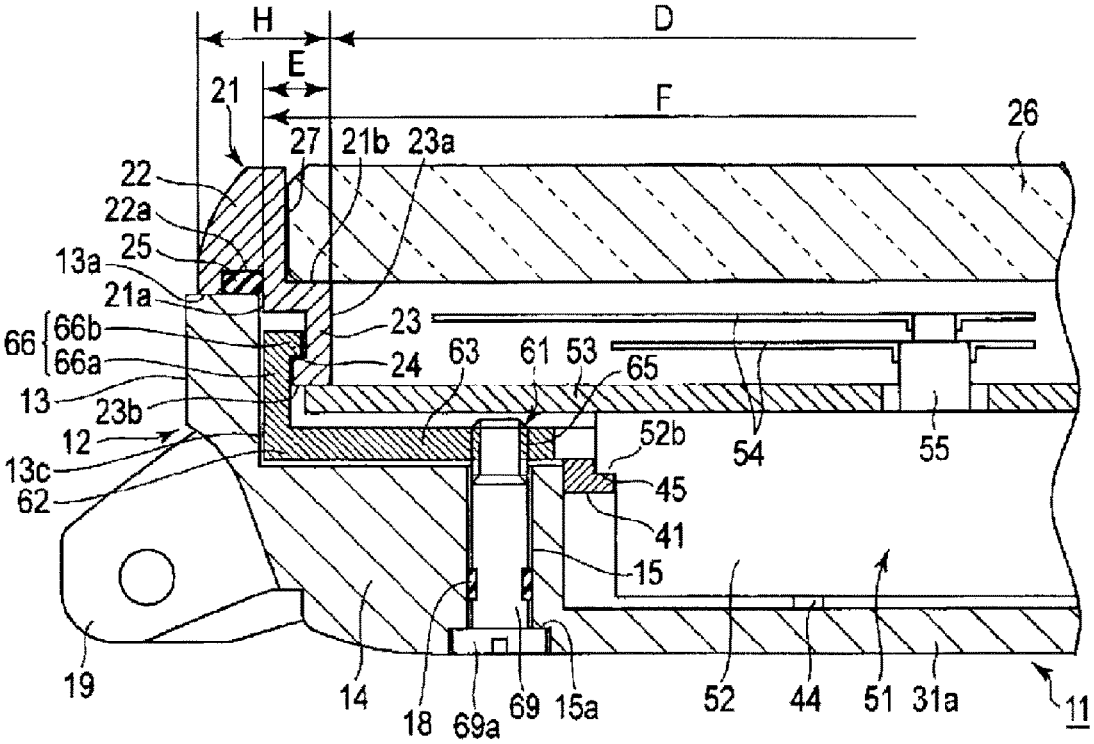
FIG. 15 is a sectional view illustrating a part of a wristwatch according to a fifth embodiment of the present invention.

FIG. 15 shows the fifth embodiment of the present invention. The wristwatch according to this fifth embodiment is of the same construction as the first embodiment except for what is described below. Thus, the components that are the same as or similar to or of the same function as those of the wristwatch 11 of the first embodiment are indicated by the same reference numerals, and a description thereof will be left out. The fifth embodiment differs from the first embodiment in the case band 13, the screws 69 serving as the screw unit, etc.

That is, in the fifth embodiment, the case band 13 has the case back portion 31*a* integrally. With this, the gasket groove 17 described in connection with the first embodiment is omitted. Further, a plurality of through-holes 15 (solely one of which is shown) formed in the case band bottom portion 14 that the case band 13 has are formed so as to have seating recesses 15*a* open in the back surface of the case band 13.

A waterproof gasket 18 is mounted, in a fit-engaged state, to the outer periphery of the respective incomplete screw portions of the screws 69 (solely one of which is shown) provided in the same number as the through-holes 15. This waterproof gasket 18 corresponds to the waterproof gasket mounted to the gasket groove 17 described in connection with the first embodiment. Each screw 69 is long enough to reach a screw hole 65 of the drawing-in member 62 from the seating recesses 15*a* in the thickness direction of the case 12.

And, the screws 69 to which the waterproof gasket 18 is mounted are inserted into the through-holes 15 from the outer side of the case band 13, and are threaded into the screw holes 65 of the drawing-in member 62. As a result, the assembly A is drawn into the case band 13, and the edge member 21 is mounted to the case band 13. In the state in which the assembly of the wristwatch 11 has been completed, the head portions 69*a* of the screws 69 are in contact with the bottom surfaces of the seating recesses 15*a*, and the head portions 69*a* are exposed through the rear surface of the case band 13, that is, the rear surface of the case 12. At the same time, the waterproof gasket 18 undergoes elastic deformation in a compressed state, and is held in close contact with the wall surface defining the through-holes 15 to secure the waterproof property against water striving to enter the case 12.

Apart from what has been described above, this embodiment is of the same construction as the first embodiment including the construction not shown in FIG. 15.

In the wristwatch 11 according to the fifth embodiment, it is possible to provide a wristwatch 11 in which the width H of the edge member 21 supporting the transparent member 26 is small for the same reason as described in connection with the first embodiment and, at the same time, it is possible to achieve all the effects described in connection with the first embodiment except for the effect due to the fact that the screw unit is contained in the case 12. In addition, in the wristwatch 11 according to the fifth embodiment, the head portions 69*a* of the screws 69 are exposed to the exterior of the case 12, so that it is possible to visually check whether or not the head portions 69*a* of the screws 69 are at predetermined position on the rear surface of the case 12. As a result, it is possible to easily check, in inspection operation or the like, to make sure that the screws 69 are mounted without fail.

The present invention is not restricted to a wristwatch as described in connection with the first through fifth embodiments, but is also applicable to a timepiece not attached to a human arm, such as a table clock or a wall-hanging timepiece. Further, the present invention is also applicable to an arm-attachment-type apparatus used while attached to a human arm, such as a smart watch, and through this application, it can reduce the width of the edge member with which the smart watch is equipped. Here, the smart watch means, for example, a portable electronic apparatus endowed with a timepiece function the movement of which is formed by an electronic circuit, making it possible to display information such as time and characters on a dial through the operation of this movement.

Further, it is also possible to apply the construction of the drawing-in mechanism 61, described in connection with the third embodiment, to the second and fourth embodiments to carry out these embodiments. Further, it is also possible to apply the construction of the drawing-in mechanism 61, described in connection with the fifth embodiment, to the first, second, and fourth embodiments to carry out these embodiments.

What is claimed is:

1. A timepiece which has a case, the timepiece comprising:

a movement having a display panel accommodated in the case, wherein the display panel extends in a width perpendicular to a thickness direction of the case;

a transparent member provided to cover the display panel;

a case band configured to form a circumference of the case surrounding the display panel;

an edge member configured to form a circumference of the case, wherein the edge member comprises:

an edge portion arranged on a front side of the case band in the thickness direction and configured to frame the transparent member;

a cylindrical portion configured to extend in the thickness direction from the edge portion toward a rear side of the case on an inner side of the case band, wherein the cylindrical portion contacts with an outer periphery of the display panel from the front side of the case to define a display surface of the display panel; and a receiving portion provided in an outer periphery or an extension of the cylindrical portion, the extension protruding in the thickness direction from the cylindrical portion toward the rear side of the case; and a drawing-in mechanism placed on the inner side of the case band and configured to hold the case band and the edge member together, the drawing-in mechanism comprising:

a plate portion being extensive in the width direction opposite to a rear surface of the display panel;

a drawing-in member formed at an outer periphery of the plate portion and having an engagement portion configured to engage with the receiving portion from the front side of the case; and a threaded portion provided to the plate portion opposite to the rear surface of the display panel on an inner side than the outer periphery of the display panel, wherein the threaded portion is configured to detachably and threadedly engaged with a screw member to hold engagement between the engagement portion and the receiving portion.

2. The timepiece according to claim 1, wherein the cylindrical portion comprises an inner peripheral surface continuous with the display panel at a right angle.

3. The timepiece according to claim 1, wherein the engagement portion has an engagement portion base and a hooking portion, the engagement portion base protruding in the thickness direction from the outer periphery of the plate portion toward the front side of the case and arranged between an inner peripheral surface of the case band and the outer periphery of the display panel, and the hooking portion formed on the engagement portion base and engaged with the receiving portion provided in the outer periphery of the cylindrical portion.

4. The timepiece according to claim 3, wherein a plurality of receiving portions are provided at angular intervals around the cylindrical portion, and a plurality of engagement portions are provided at the same angular intervals and in the same number as the receiving portions around the outer periphery of the plate portion, and further wherein the receiving portions are formed to have a passage between two adjacent receiving portions, and the passages have a circumferential length long enough for the hooking portions of the engagement portions to pass through the passages in the thickness direction toward the front side of the case so that the hooking portions can engage with the receiving portions when the drawing-in mechanism is rotated relative to the case band.

5. The timepiece according to claim 4, wherein the plurality of receiving portions each have an engagement groove open on the front side of the case, the engagement groove having a circumferential length substantially equal to a circumferential length of the hooking portion so that the engagement grooves can receive the hooking portions.

6. The timepiece according to claim 1, wherein the receiving portion is formed in the extension protruding in the thickness direction from the cylindrical portion toward the rear side of the case band, the receiving portion has a receiving portion base arranged between an inner peripheral surface of the case band and the outer periphery of the display panel, and a lock portion is formed on the receiving portion base and configured to receive, from the rear side of the case, the engagement portion formed around an outer periphery of the plate portion.

7. The timepiece according to claim 6, wherein a plurality of receiving portions are provided at angular intervals around the cylindrical portion, and a plurality of engagement portions are provided at the same angular intervals and in the same number as the receiving potions around the outer periphery of the plate portion, and further wherein the receiving portions are formed to have a passage between two adjacent receiving portions, and the passages have a circumferential length long enough for the lock portions of the engagement portions to pass through the passages in the thickness direction toward the front side of the case so that the hooking portions can engage with the receiving portion when the drawing-in mechanism is rotated relative to the case band.

8. The timepiece according to claim 1, further comprising a screw threadedly engaged with the threaded portion of the plate portion.

9. The timepiece according to claim 8, wherein the screw is arranged on the inner side of the case band and covered with and hidden by a case back of the case mounted to the case band.

10. The timepiece according to claim 1, wherein the case is comprises a case back arranged to contact with the case band from the rear side of the case, the case back comprising a first annular tubular portion protruding in the thickness direction from the case back toward the front side of the case, the first annular tubular portion having a threaded outer peripheral surface, and the drawing-in member further comprises a second annular tubular portion protruding in the thickness direction from the plate portion toward the rear side of the case, the second annular tubular portion having a threaded inner peripheral surface threadedly engaged with the threaded outer peripheral surface of the first annular tubular portion of the case back.

11. The timepiece according to claim 3, wherein the cylindrical portion is formed with a plurality of receiving portions provided in the thickness direction along the outer periphery of the cylindrical portion, and the drawing-in member is formed with a plurality of hooking portions provided in the thickness direction, the plurality of receiving portions and the plurality of hooking portions are engaged with each other.

12. The timepiece according to claim 8, wherein a head portion of the screw is exposed from a rear surface of the case.

* * * * *